US011620964B2

(12) United States Patent
Ishihara et al.

(10) Patent No.: US 11,620,964 B2
(45) Date of Patent: Apr. 4, 2023

(54) DISPLAY DEVICE

(71) Applicant: Japan Display Inc., Tokyo (JP)

(72) Inventors: Tomoyuki Ishihara, Tokyo (JP); Kazuhiko Sako, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/343,074

(22) Filed: Jun. 9, 2021

(65) Prior Publication Data

US 2021/0390925 A1 Dec. 16, 2021

(30) Foreign Application Priority Data

Jun. 10, 2020 (JP) ..... JP2020-101274

(51) Int. Cl.
*G09G 5/10* (2006.01)
*G09G 3/3275* (2016.01)

(52) U.S. Cl.
CPC ..... *G09G 5/10* (2013.01); *G09G 3/3275* (2013.01); *G09G 2320/0233* (2013.01); *G09G 2340/0428* (2013.01)

(58) Field of Classification Search
CPC ..... G09G 5/10; G09G 3/3275; G09G 2320/0233; G09G 2340/0428; G09G 2320/0271; G09G 2320/062; G09G 2320/0646; G09G 2320/0686; G09G 2360/16; G09G 3/2092; G09G 2370/08; G09G 3/3666; G09G 3/3688; G09G 3/3426
See application file for complete search history.

(56) References Cited

U.S. PATENT DOCUMENTS

2007/0097064 A1* 5/2007 Okita ..... G09G 3/3648 345/101
2010/0123741 A1* 5/2010 Shin ..... G09G 3/3426 345/211
2010/0245405 A1* 9/2010 Murai ..... G09G 3/3406 345/102
2013/0162700 A1* 6/2013 Yamakawa ..... G09G 5/10 345/690
2018/0091697 A1* 3/2018 Fujita ..... H04N 1/295
2018/0277048 A1* 9/2018 Komanduri ..... G02B 6/0031
2019/0043162 A1* 2/2019 Saito ..... G09G 3/001
2019/0197943 A1* 6/2019 Mizunaga ..... G09G 3/3674
2021/0366359 A1* 11/2021 Hong ..... G09G 3/2096

FOREIGN PATENT DOCUMENTS

JP 2019-113672 A 7/2019

* cited by examiner

*Primary Examiner* — Antonio Xavier
(74) *Attorney, Agent, or Firm* — K&L Gates LLP

(57) ABSTRACT

According to an aspect, a display device includes: a display panel that has a display area in which a plurality of pixels are arranged; a light source configured to illuminate the display area; a first control circuit configured to receive first signals corresponding to a first partial image to be displayed in a portion of the display area; and a second control circuit configured to receive second signals corresponding to a second partial image to be displayed in another portion of the display area. The light source has a plurality of light-emitting areas in each of which a light emission intensity is individually controllable. The first control circuit is configured to transmit lighting quantity information indicating the light emission intensity of each of the light-emitting areas to the second control circuit.

19 Claims, 15 Drawing Sheets

DISPLAY DEVICE

CROSS-REFERENCE TO RELATED APPLICATION

This application claims the benefit of priority from Japanese Patent Application No. 2020-101274 filed on Jun. 10, 2020, the entire contents of which are incorporated herein by reference.

BACKGROUND

1. Technical Field

What is disclosed herein relates to a display device.

2. Description of the Related Art

In general, an active-matrix display device is provided with a source driver that outputs pixel signals to a plurality of pixels in accordance with external input of image data. Recent increase in number of pixels of the display device resulting from technological progress has led to an increase in number of input and output signal terminals of the source driver. As a result, the degree of technical difficulty has increased in providing a single source driver with input and output signal terminals to correspond to all the pixels. A method is known to reduce the number of the input and output signal terminals for one source driver by providing two source drivers that output the pixel signals to the pixels in accordance with the external input of the image data (for example, Japanese Patent Application Laid-open Publication No. 2019-113672).

In a case of trying to introduce a function to control gradations of the pixels corresponding to light source control, such as local dimming, in a display device provided with a plurality of source drivers, a new circuit is required that serves as a controller or a bridge for making the gradation control of the pixels correspondent to the light emission control of the light source. Simply introducing a new circuit corresponding to the function increases the number of circuits of the display device that is already provided with a plurality of source drivers, and thus, leads to increase in the degree of design difficulty and cost of the display device. If the function is simply incorporated in each of the source drivers to independently operate the source drivers, the entire display device is difficult to be controlled in an integrated manner.

For the foregoing reasons, there is a need for a display device capable of both achieving the light emission control of the light source and restraining the increase in the number of circuits for achieving the light emission control.

SUMMARY

According to an aspect, a display device includes: a display panel that has a display area in which a plurality of pixels are arranged; a light source configured to illuminate the display area; a first control circuit configured to receive first signals corresponding to a first partial image to be displayed in a portion of the display area; and a second control circuit configured to receive second signals corresponding to a second partial image to be displayed in another portion of the display area. The light source has a plurality of light-emitting areas in each of which a light emission intensity is individually controllable. The first control circuit is configured to transmit lighting quantity information indicating the light emission intensity of each of the light-emitting areas to the second control circuit.

DETAILED DESCRIPTION

Figure 1:
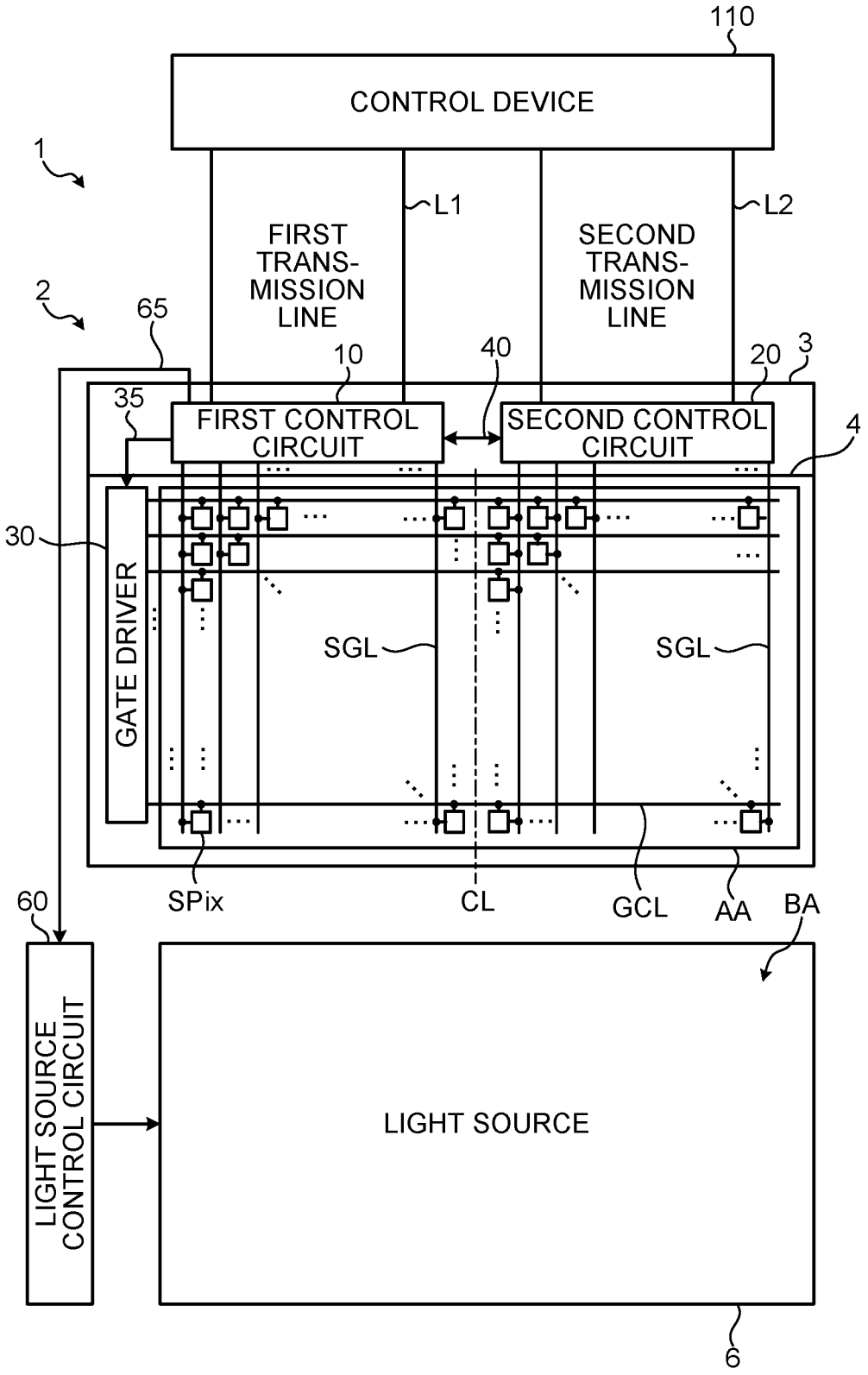
FIG. 1 is a schematic diagram illustrating an exemplary main configuration of a display device according to an embodiment.

The following describes an embodiment of the present disclosure with reference to the drawings. What is disclosed herein is merely an example, and the present disclosure naturally encompasses appropriate modifications easily conceivable by those skilled in the art while maintaining the gist of the disclosure. To further clarify the description, widths, thicknesses, and shapes, for example, of various parts are schematically illustrated in the drawings as compared with actual aspects thereof, in some cases. However, they are merely examples, and interpretation of the present disclosure is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

Embodiment

FIG. 1 is a schematic diagram illustrating an exemplary main configuration of a display device 1 according to an embodiment of the present disclosure. The display device 1 includes a display panel 2 and a light source 6. The display device 1 is a liquid crystal display device that transmits light from the light source 6 to the display panel 2 to display an image. In the following description, the term "coupled" refers to "electrically coupled" unless otherwise stated.

The display panel 2 is what is called a transmissive liquid crystal display panel, but is not limited thereto, and may be, for example, a transflective liquid crystal display panel. The display panel 2 includes a first substrate 3 and a second substrate 4. The first substrate 3 and the second substrate 4 are stacked on each other with a liquid crystal layer (not illustrated) interposed therebetween. An overlapped area of the first substrate 3, the second substrate 4, and the liquid crystal layer includes a display area AA. The display area AA is provided with a plurality of sub-pixels SPix. Each of the first substrate 3 and the second substrate 4 is, for example, a glass substrate, but may be a substrate made of other light-transmitting material.

Figure 2:
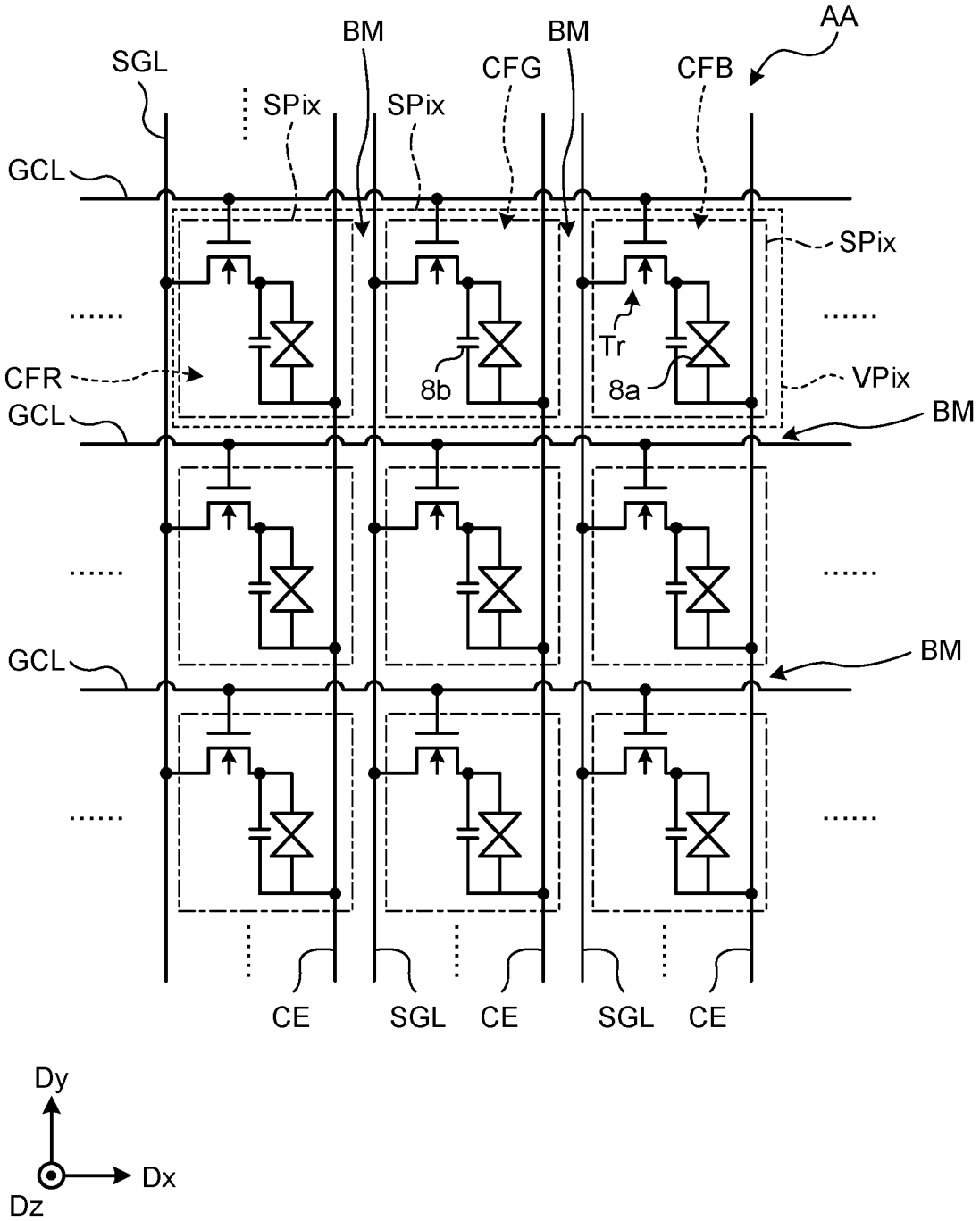
FIG. 2 is a diagram illustrating an exemplary arrangement of pixels and sub-pixels of a display panel.

FIG. 2 is a diagram illustrating an exemplary arrangement of pixels VPix and the sub-pixels SPix of the display panel 2. Each of the sub-pixels SPix includes a switching element Tr and a liquid crystal capacitor 8*a*. The switching element Tr includes a thin-film transistor (TFT), and in this example, an n-channel metal oxide semiconductor (MOS) TFT. An insulating layer is provided between a pixel electrode and a common electrode (which are to be described later), and these components form a holding capacitor 8*b* illustrated in FIG. 2.

For example, the switching elements Tr of the respective sub-pixels SPix, signal lines SGL, and scan lines GCL illustrated in FIG. 2 are formed on the first substrate 3. The signal lines SGL are wiring for supplying a pixel signal to the pixel electrode included in each of the sub-pixels SPix. The scan lines GCL are wiring for supplying a drive signal for driving each of the switching elements Tr. The signal lines SGL and the scan lines GCL extend in a plane parallel to a surface of the first substrate 3 illustrated in FIG. 2.

The pixel electrodes are provided on the first substrate 3. The display device 1 includes the common electrode different from the pixel electrode. The common electrode is provided, for example, on the second substrate 4, but may be provided in a layer different from that of the pixel electrode on the first substrate 3. A holding potential of the holding capacitor 8*b* is determined in accordance with each of the pixel signals that are supplied to the signal lines SGL at time when the switching elements Tr are driven in response to the drive signals transmitted through the scan lines GCL. The orientation of liquid crystals in each of the sub-pixels SPix is determined depending on a potential difference between the pixel electrode and the common electrode that is generated depending on the holding potential. As a result, the degree of transmission of light at each of the sub-pixels SPix is determined. The pixel electrodes may be provided on the second substrate 4, and the common electrode may be provided on the first substrate 3 or the second substrate 4. The pixel electrodes and the common electrode are electrodes formed using a light-transmitting material such as indium tin oxide (ITO).

As illustrated in FIG. 2, a light-blocking layer BM is formed so as to extend along the signal lines SGL and the scan lines GCL. Although FIG. 2 illustrates electrical coupling of the switching elements Tr, the light-blocking layer BM actually overlaps also the switching elements Tr. Each of the sub-pixels SPix has an opening surrounded by the light-blocking layer BM. Color filters CFR, CFG, and CFB colored in three colors of red (R), green (G), and blue (B) correspond, as one set, to the openings of the sub-pixels SPix illustrated in FIG. 2. The sub-pixels SPix corresponding to the color filters CFR, CFG, and CFB in the three colors constitute, as one set, each of the pixels VPix. The color filters may include color regions in four or more colors.

As illustrated in FIG. 2, the pixels VPix are arranged in a matrix having a row-column configuration in the display area AA of the display panel 2. Hereinafter, the expression "in a matrix" refers to a matrix form corresponding to the row-column direction in which one of a first direction Dx and a second direction Dy corresponds to the row, and the other thereof corresponds to the column. A third direction Dz denotes a direction orthogonal to the first direction Dx and the second direction Dy. The first substrate 3, the liquid crystal layer, and the second substrate 4 are stacked in the third direction Dz.

As illustrated in FIG. 2, the sub-pixels SPix arranged in the first direction Dx share a corresponding one of the scan lines GCL. In addition, the sub-pixels SPix arranged in the second direction Dy share a corresponding one of the signal lines SGL.

As illustrated in FIG. 1, some of the signal lines SGL are coupled to a first control circuit 10, and the others of the signal lines SGL are coupled to a second control circuit 20. FIG. 1 illustrates a borderline CL between an area in which the sub-pixels SPix that share the signal lines SGL coupled to the first control circuit 10 are arranged and an area in which the sub-pixels SPix that share the signal lines SGL coupled to the second control circuit 20 are arranged. The borderline CL is located, for example, so as to divide the display area AA into two to form the two areas arranged in the first direction Dx. However, the dividing position of the display area AA defined by the borderline CL is not limited to this position, and may be changed as appropriate (refer to FIG. 15).

The first control circuit 10 and the second control circuit 20 supply the pixel signals through the signal lines SGL to the sub-pixels SPix. The first control circuit 10 illustrated in FIG. 1 supplies the pixel signals to the sub-pixels SPix in response to first signals supplied through first transmission lines L1 from a control device 110 outside the display device 1. The second control circuit 20 supplies the pixel signals to the sub-pixels SPix in response to second signals supplied through second transmission lines L2 from the control device 110. The first signals are signals to cause the display device 1 to display an image to be displayed in a partial area of the display area AA in which some of the pixels VPix are arranged. The aforementioned some pixels VPix are the pixels VPix made up of the sub-pixels SPix sharing the signal lines SGL coupled to the first control circuit 10. The second signals are signals to cause the display device 1 to display an image to be displayed in a partial area of the display area AA in which the others of the pixels VPix are arranged. The others of the pixels VPix are the pixels VPix made up of the sub-pixels SPix sharing the signal lines SGL coupled to the second control circuit 20.

Figure 6:
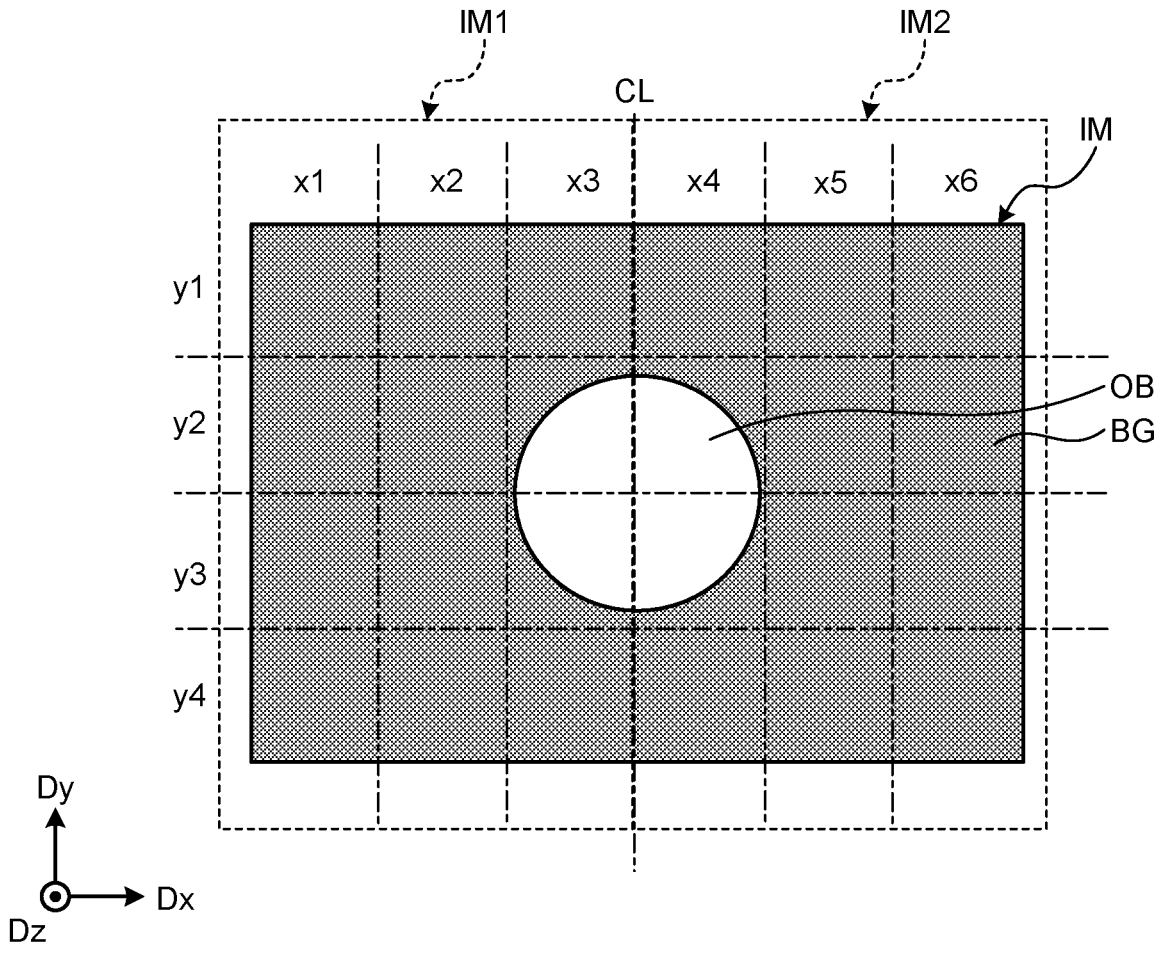
FIG. 6 is a schematic diagram illustrating an example of image data based on first signals and second signals.

The control device 110 is what is called a host computer that externally supplies image data such as image data IM (refer to FIG. 6). The first transmission lines L1 and the second transmission lines L2 each have a configuration including a plurality of wiring lines such as that of a flexible printed circuit (FPC) board. However, the configuration is not limited thereto and may be another configuration that serves as a plurality of wiring lines.

A gate driver 30 is coupled to the scan lines GCL. The gate driver 30 supplies the drive signal to each of the scan lines GCL. The gate driver 30 simultaneously supplies the drive signal to a predetermined number of the scan lines GCL. The gate driver 30 performs scanning in which the scan lines GCL to share the drive signal are shifted on a per predetermined number of scan line basis. The first control circuit 10 and the second control circuit 20 output the pixel signals to the sub-pixels SPix coupled to the scan lines GCL supplied with the drive signal. The predetermined number is a number equal to or smaller than the half of the total number of the scan lines GCL. The predetermined number is, for example, one, but may be two or larger. The first control circuit 10 is coupled to the gate driver 30 through wiring 35. The first control circuit 10 is coupled to the second control circuit 20 through a transmission portion 40.

Each of the first control circuit 10, the second control circuit 20, and the gate driver 30 is, for example, a circuit mounted on an individual semiconductor chip. The first control circuit 10, the second control circuit 20, and the gate driver 30 are provided, for example, on the first substrate 3, but may be provided on the second substrate 4.

Figure 3:
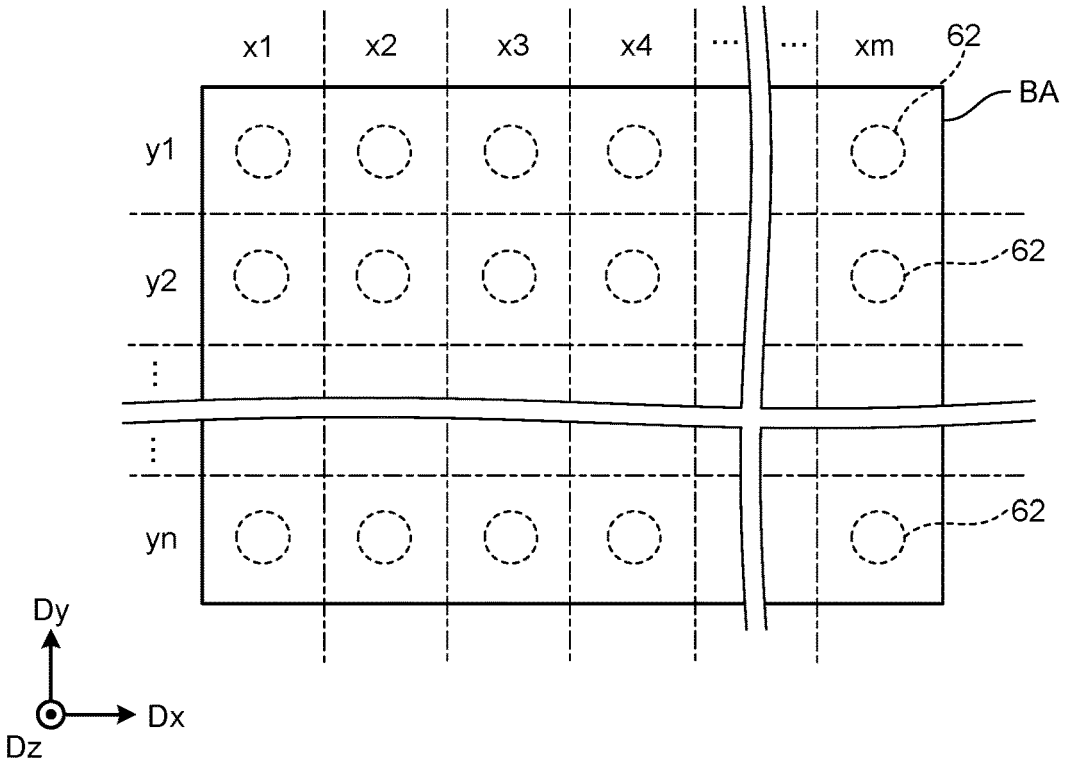
FIG. 3 is a schematic diagram illustrating an exemplary arrangement of a plurality of light source elements in a light-emitting portion.

As illustrated in FIG. 1, the light source 6 includes a light-emitting portion BA that emits the light to illuminate the display area AA from one side thereof. The light source 6 is disposed such that the light-emitting portion BA overlaps the display area AA in the third direction Dz. FIG. 3 is a schematic diagram illustrating an exemplary arrangement of a plurality of light source elements 62 in the light-emitting portion BA. The light source elements 62 are arranged in the light-emitting portion BA. Each of the light source elements 62 may be made up of a single light source element such as one light-emitting diode (LED) or may be made up of a plurality of light source elements having, for example, a configuration including a plurality of LEDs. The specific configuration of the light source element is not limited to that of the LED and may be that of another light-emitting element such as a light-emitting element using an organic or inorganic electroluminescence effect.

As illustrated in FIG. 3, the light source elements 62 are arranged in a matrix in the light-emitting portion BA. In order to distinguish areas where the respective light source elements 62 are disposed from one another, FIG. 3 illustrates a coordinate system represented by coordinates x1, x2, xm in the first direction Dx and coordinates y1, y2, . . . , yn in the second direction Dy. Here, m and n are natural numbers equal to or larger than two.

In the description of the embodiment, a light-emitting area denotes an area that is handled using the coordinate system illustrated in FIG. 3, and in which the light emission is individually controllable on a light source element 62 basis. That is, the light-emitting portion BA has a plurality of the light-emitting areas. One light-emitting area includes one of the light source elements 62.

A light source control circuit 60 illustrated in FIG. 1 individually controls a degree of light emission of each of the light source elements 62. Since the light emission from each of the light source elements 62 is individually controlled, the display device 1 of the embodiment performs what is called local dimming in which luminance control is performed for each of the light-emitting areas. The first control circuit 10 is coupled to the light source control circuit 60 through wiring 65.

As will be described later with reference to FIG. 8, each of the light source elements 62 is provided so as to diffuse the light emitted toward the display panel 2 to outside the light-emitting area provided with the light source element 62 in plan view in the first direction Dx and the second direction Dy. With this configuration, in a situation where the light needs to be more uniform over the entire light-emitting portion BA, such as a situation where all the light source elements 62 are lit up, more even light can be emitted, and light emission uniformity in the display device 1 can be ensured.

The specific configuration of the light source control circuit 60 corresponds to the specific configuration of the light source element 62. For example, when the light source element 62 is the LED, the light source control circuit 60 is what is called an LED driver circuit. The light source control circuit 60 may be provided on a substrate of the light source 6 where the light source elements 62 are arranged or may be provided on a substrate, such as the first substrate 3, included in the display panel 2.

Figure 4:
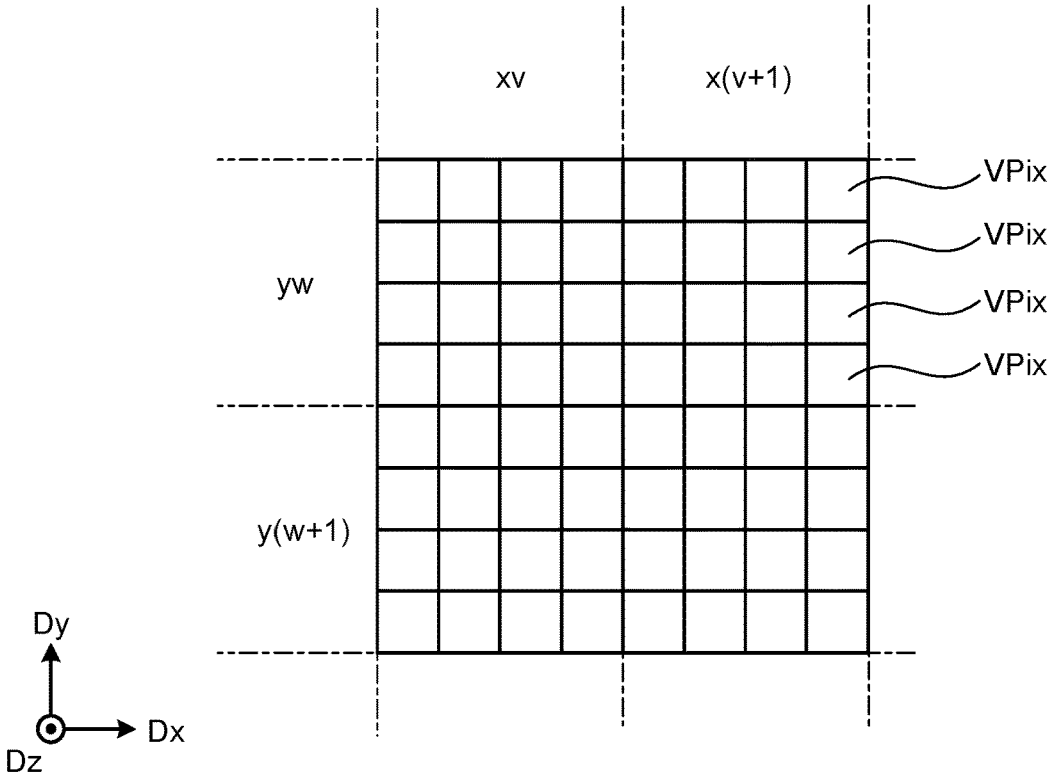
FIG. 4 is a schematic diagram illustrating an example of a plurality of the pixels arranged so as to overlap one light-emitting area.

FIG. 4 is a schematic diagram illustrating an example of a plurality of the pixels VPix arranged so as to overlap one of the light-emitting areas. As illustrated in FIG. 4, in the embodiment, the pixels VPix are arranged so as to overlap each of the light-emitting areas. In the following description, an area including the pixels VPix overlapping one of the light-emitting areas may be referred to as a partial area of the display area AA. That is, the display area AA includes a plurality of partial areas corresponding to the number of the light-emitting areas.

In FIG. 4, 16 (=4×4) of the pixels VPix are arranged in a matrix in the partial area of the display area AA overlapping one of the light-emitting areas. However, the arrangement of the pixels VPix is not limited to this arrangement. The number of the pixels arranged in each of the partial areas and the specific arrangement of the pixels are freely set. However, the number of the pixels is equal to or larger than two.

In FIG. 4, the partial areas overlapping 4 (=2×2) of the light-emitting areas are represented by two coordinates xv, x(v+1) of the coordinates x1, x2, . . . , xm and two coordinates yw, y(w+1) of the coordinates y1, y2, . . . , yn. The other partial areas that are included in the display area AA and not illustrated in FIG. 4 have the same configuration. Note that $1 \leq v \leq (m-1)$, and $1 \leq w \leq (n-1)$.

Figure 5:
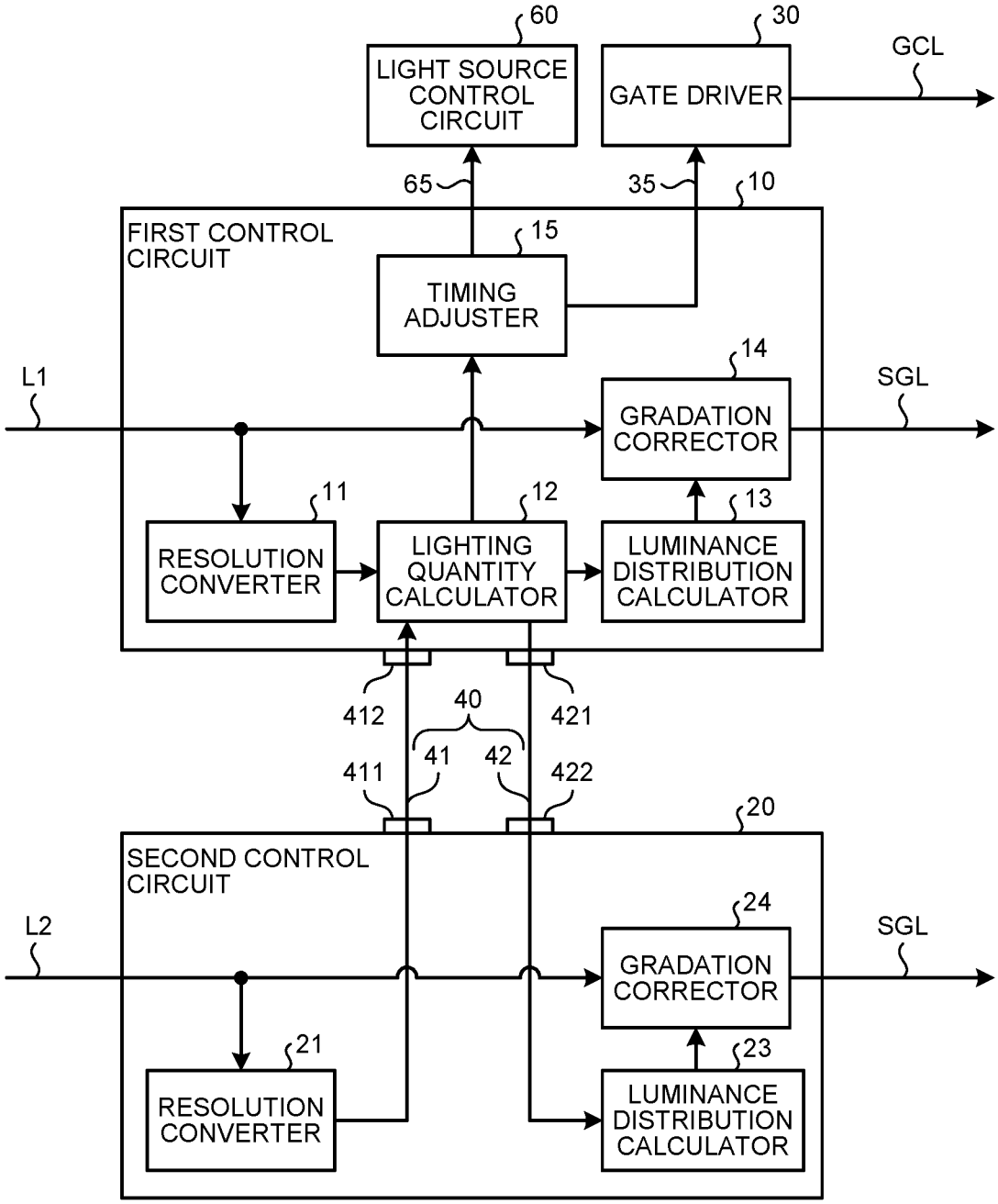
FIG. 5 is a block diagram illustrating an exemplary specific configuration of a first control circuit and a second control circuit, and an exemplary coupling relation between the first control circuit and the second control circuit.

FIG. 5 is a block diagram illustrating an exemplary specific configuration of the first control circuit 10 and the second control circuit 20, and an exemplary coupling relation between the first control circuit 10 and the second control circuit 20. The first control circuit 10 includes a resolution converter 11, a lighting quantity calculator 12, a luminance distribution calculator 13, a gradation corrector 14, and a timing adjuster 15. The second control circuit 20 includes a resolution converter 21, a luminance distribution calculator 23, and a gradation corrector 24. The transmission portion 40 includes a first transmission portion 41 and a second transmission portion 42.

The first signals are supplied from the control device 110 through the first transmission lines L1 to the resolution converter 11 and the gradation corrector 14 of the first control circuit 10. The second signals are supplied from the control device 110 through the second transmission lines L2 to the resolution converter 21 and the gradation corrector 24 of the second control circuit 20.

FIG. 6 is a schematic diagram illustrating an example of the image data IM based on the first signals and the second signals. For the purpose of simplifying the description, FIG. 6 and FIGS. 7, 8, and 9 (to be described later) illustrate a case where m=6 and n=4.

The image data IM is image data displayable by the pixels VPix arranged in the display area AA. The image data IM includes first partial image data IM1 and second partial image data IM2. The first partial image data IM1 is one of two pieces of partial image data obtained by dividing the image data IM with the borderline CL. The second partial image data IM2 is the other of the two pieces of partial image data obtained by dividing the image data IM with the borderline CL.

In the case of the example illustrated in FIG. 6, the first signals are signals for causing the display panel 2 to perform display output of a partial image corresponding to the first partial image data IM1. Also, the second signals are signals for causing the display panel 2 to perform display output of a partial image corresponding to the second partial image data IM2. More specifically, the first signals are signals including the pixel signals corresponding to the pixels VPix included in an area of the coordinates x1, x2, and x3 in the first direction Dx in FIG. 6. Also, the second signals are signals including the pixel signals corresponding to the pixels VPix included in an area of the coordinates x4, x5, and x6 in the first direction Dx in FIG. 6.

The pixel signals are signals including information indicating gradation values of the pixels VPix. For example, when the image data IM is what is called red-green-blue (RGB) data, each of the pixel signals includes information indicating gradation values of the sub-pixels SPix for red (R), green (G), and blue (B) included in one of the pixels VPix. In an exemplary case where the gradation value of each of the sub-pixels SPix is represented by eight bits, the pixel signal for the pixel VPix that outputs the lowest luminance (black) can be represented as (R, G, B)=(0, 0, 0). In this case, the pixel signal for the pixel VPix that outputs the highest luminance (white) can be represented as (R, G, B)=(255, 255, 255). The number of bits of the gradation values is not limited to eight, and can be any value. The color space of the image data IM and the pixel signals is not limited to what is called an RGB color space, and may be other color space. Each color component included in the pixel signals is individually supplied to the sub-pixel SPix for a corresponding color included in the pixel VPix.

The image data IM illustrated in FIG. 6 includes an object OB and a background BG. The object OB is located in a position overlapping the borderline CL. One portion of the object OB is located on the first partial image data IM1 side of the borderline CL, and the other portion of the object OB is located on the second partial image data IM2 side of the borderline CL. The object OB is supplied with the pixel signals having gradation values higher than that of the background BG. The background BG is located around the object OB. One portion of the background BG is located on the first partial image data IM1 side of the borderline CL, and the other portion of the background BG is located on the second partial image data IM2 side of the borderline CL.

Assume that the gradation values of the pixels VPix included in the object OB are all equal. Assume that the gradation values of the pixels VPix included in the background BG are all equal. In the following description, assume that the object OB is set to have gradation values corresponding to the highest luminance (white). In addition, assume that the background BG is set to have gradation values corresponding not to the lowest luminance (black) but to lower luminance than the highest luminance (white).

Based on the signals received from the control device 110, the resolution converter 11 and the resolution converter 21 generate low-resolution data having a resolution lower than that of an image corresponding to the received signals.

Figure 7:
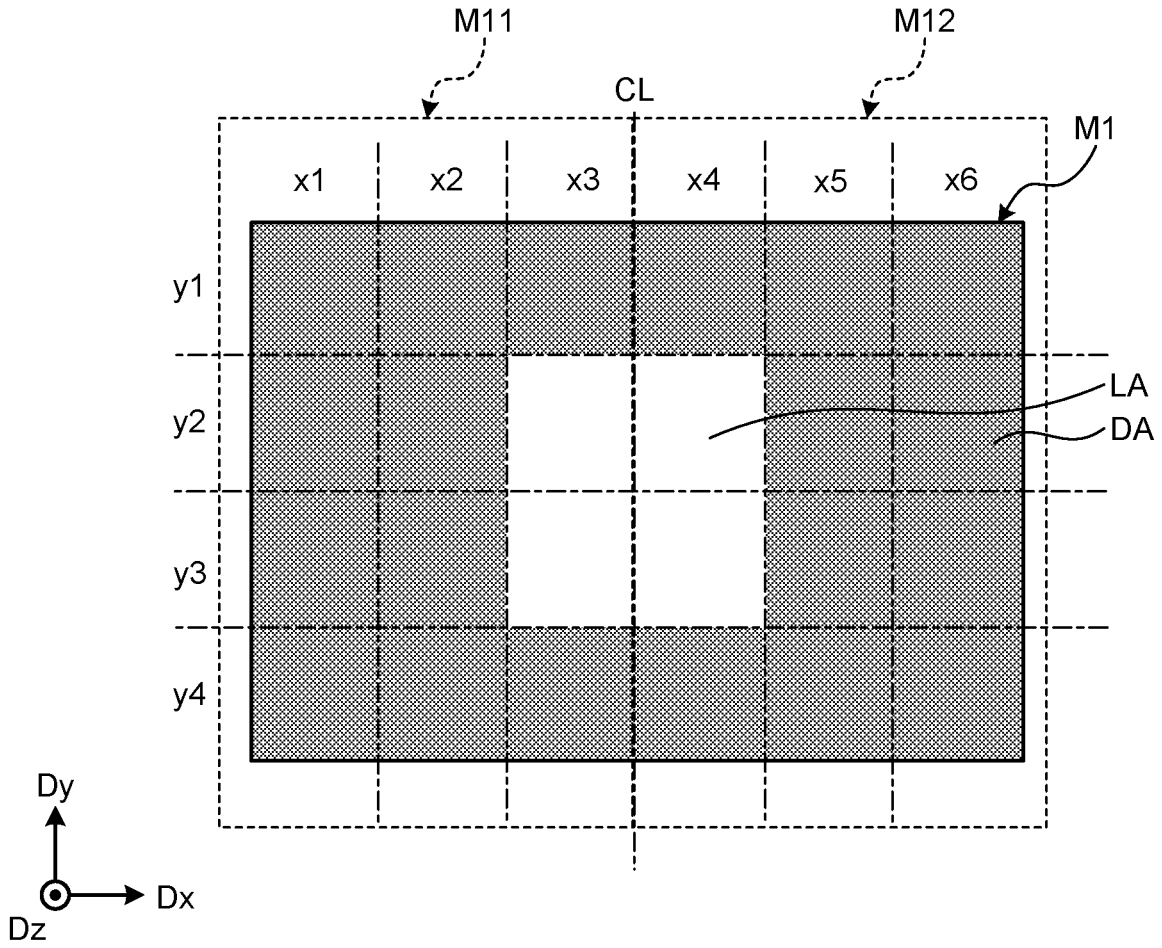
FIG. 7 is a schematic diagram illustrating an example of low-resolution data corresponding to the image data illustrated in FIG. 6.

FIG. 7 is a schematic diagram illustrating an example of low-resolution data M1 corresponding to the image data IM illustrated in FIG. 6. The low-resolution data M1 is lower-resolution data of the image data IM. Specifically, the low-resolution data M1 is data indicating gradation values corresponding to one of the pixels VPix having the highest gradation among the gradations of the respective light-emitting areas. The data amount of the low-resolution data M1 is smaller than that of the image data IM.

Taking the number of the pixels VPix in each of the light-emitting areas illustrated in FIG. 4 as an example, in the image data IM illustrated in FIG. 6, each of the 24 partial areas has 16 pixels VPix, where the number 24 is obtained by multiplying the number of the coordinates (m=6) in the first direction Dx by the number of the coordinates (n=4) in the second direction Dy. Thus, the image data IM has a data amount corresponding to the number of the pixels of 384 (=24×16). In contrast, the low-resolution data M1 illustrated in FIG. 7 is generated as data indicating the gradation value of one of the pixels VPix having the highest gradation among the gradations of the 24 partial areas, where the number 24 is obtained by multiplying the number of the coordinates (m=6) in the first direction Dx by the number of the coordinates (n=4) in the second direction Dy. Thus, the image data IM has a data amount corresponding to the number of the pixels of 24 (=24×1). As a result, in this example, the data amount of the low-resolution data M1 is 1/16th of the data amount of the image data IM.

More specifically, the low-resolution data M1 illustrated in FIG. 7 includes a high-gradation portion LA and a low-gradation portion DA. The high-gradation portion LA is a partial area of the display area AA in which the gradation values are set to the values corresponding to the object OB. The partial area set to be the high-gradation portion LA of the low-resolution data M1 corresponds to a partial area of the image data IM including the object OB. That is, a partial area corresponding to the coordinates (x3, y2), (x4, y2), (x3, y3), and (x4, y3) that includes the object OB in the image data IM serves as the partial area set to be the high-gradation portion LA of the low-resolution data M1.

The low-gradation portion DA is a partial area of the display area AA in which the gradation values are set to the values corresponding to the background BG. The partial area set to be the low-gradation portion DA of the low-resolution data M1 corresponds to a partial area of the image data IM including the background BG. That is, a partial area corresponding to coordinates other than the coordinates (x3, y2), (x4, y2), (x3, y3), and (x4, y3) in the image data IM serves as the partial area set to be the low-gradation portion DA of the low-resolution data M1. Although the coordinates (x3, y2), (x4, y2), (x3, y3), and (x4, y3) in the image data IM also include the background BG, the object OB has gradation values higher than those of the background BG. Thus, the gradation values of the object OB are given a higher priority at the coordinates (x3, y2), (x4, y2), (x3, y3), and (x4, y3), so that the partial area corresponding to the coordinates (x3, y2), (x4, y2), (x3, y3), and (x4, y3) is set to be the high-gradation portion LA.

The resolution converter 11 receives the first signals corresponding to the first partial image data IM1 including the signals for the area of the coordinates x1, x2, and x3 in the first direction Dx. Consequently, the resolution converter 11 generates first low-resolution data M11 of the low-resolution data M1 that includes the data for the area of the coordinates x1, x2, and x3 in the first direction Dx. The resolution converter 21 receives the second signals corresponding to the second partial image data IM2 including the signals for the area of the coordinates x4, x5, and x6 in the first direction Dx. Consequently, the resolution converter 21 generates second low-resolution data M12 of the low-resolution data M1 that includes the data for the area of the coordinates x4, x5, and x6 in the first direction Dx.

As described above, the resolution converter 11 illustrated in FIG. 5 serves as a first resolution converter that generates the first low-resolution data M11 based on the first signals, the first low-resolution data M11 having a resolution lower than that of the first partial image data IM1. The resolution converter 21 illustrated in FIG. 5 serves as a second resolution converter that generates the second low-resolution data M12 based on the second signals, the second low-resolution data M12 having a resolution lower than that of the second partial image data IM2. As illustrated in FIG. 5, the resolution converter 21 transmits the second low-resolution data M12 to the lighting quantity calculator 12. That is, the second control circuit 20 transmits the second low-resolution data M12 to the first control circuit 10. The second low-resolution data M12 to be transmitted is output from a terminal 411 of the second control circuit 20. The terminal 411 is coupled to a terminal 412 of the first control circuit 10. The first transmission portion 41 couples the terminal 411 to the terminal 412.

Components such as the first transmission portion 41 and the second transmission portion 42 (which is to be described later) included in the transmission portion 40 may be wiring that is mounted on a substrate, such as the first substrate 3, provided with the first control circuit 10 and the second control circuit 20, or may be coated wiring that is provided independently of the substrate and couples input and output terminals to one another. The coated wiring refers to wiring coated with an insulating material and includes also FPCs.

As described above, the second control circuit 20 includes the terminal 411 for outputting the second low-resolution data M12 to the first control circuit 10. The terminal 411 serves as a second output terminal. The first control circuit 10 includes the terminal 412 for receiving the second low-resolution data M12. The terminal 412 serves as a second input terminal.

The lighting quantity calculator 12 generates lighting quantity information based on the first low-resolution data M11 and the second low-resolution data M12. The lighting quantity information is information indicating a light emission intensity of each of the light-emitting areas. The lighting quantity calculator 12 combines the first low-resolution data M11 generated by the resolution converter 11 with the second low-resolution data M12 generated by the resolution converter 21 to obtain the low-resolution data M1. The lighting quantity calculator 12 generates the lighting quantity information based on the low-resolution data M1.

Specifically, the light emission intensity of each of the light-emitting areas indicated by the lighting quantity information is determined based on the highest gradation value of the gradation values of the pixels VPix arranged in each of portions corresponding to the light-emitting areas. More specifically, the lighting quantity information is generated as information to light the light source element 62 in each of the light-emitting areas so as to obtain luminance required for the pixel VPix having the highest gradation value in each of the partial areas. Thus, the lighting quantity information corresponding to the low-resolution data M1 illustrated in FIG. 7 includes information to light each of the light source elements 62 arranged in the light-emitting areas at the coordinates (x3, y2), (x4, y2), (x3, y3), and (x4, y3) at a light emission intensity for obtaining the luminance of the high-gradation portion LA. The lighting quantity information includes information to light each of the light source elements 62 arranged in the light-emitting areas at coordinates other than the coordinates (x3, y2), (x4, y2), (x3, y3), and (x4, y3) at a light emission intensity for obtaining the luminance of the low-gradation portion DA.

The light emitted from the light source element 62 in each of the light-emitting areas is radially diffused from the light source 6 toward the second substrate 4. Thus, each of the partial areas of the display area AA is affected by light from not only the light-emitting area directly overlapping the partial area but also other light-emitting areas. The other light-emitting areas refer to light-emitting areas adjacent to the light-emitting area directly overlapping the partial area in the first direction Dx, the second direction Dy, or oblique directions. The oblique directions refer to directions extending along a plane along the first direction Dx and the second direction Dy and intersecting the first direction Dx and the second direction Dy. Thus, the light emission intensity of the light source element 62 of each of the light-emitting areas is derived taking into account the effect of the light from the other light-emitting areas.

The lighting quantity calculator 12 outputs the lighting quantity information to the luminance distribution calculator 13. The lighting quantity calculator 12 also outputs the lighting quantity information to the luminance distribution calculator 23. That is, the first control circuit 10 transmits the lighting quantity information to the second control circuit 20. The lighting quantity information to be transmitted is output from a terminal 421 of the first control circuit 10. The terminal 421 is coupled to a terminal 422 of the second control circuit 20. The second transmission portion 42 couples the terminal 421 to the terminal 422.

As described above, the first control circuit 10 includes the terminal 421 for outputting the lighting quantity information. The terminal 421 serves as a first output terminal. The second control circuit 20 includes the terminal 422 for receiving the lighting quantity information. The terminal 422 serves as a first input terminal. The terminal 421 is coupled to the terminal 422.

The luminance distribution calculator 13 and the luminance distribution calculator 23 obtain a luminance distribution M2 of the light from the light source 6 based on the lighting quantity information. The luminance distribution calculator 13 illustrated in FIG. 5 serves as a first luminance distribution calculator. The luminance distribution calculator 23 illustrated in FIG. 5 serves as a second luminance distribution calculator.

Figure 8:
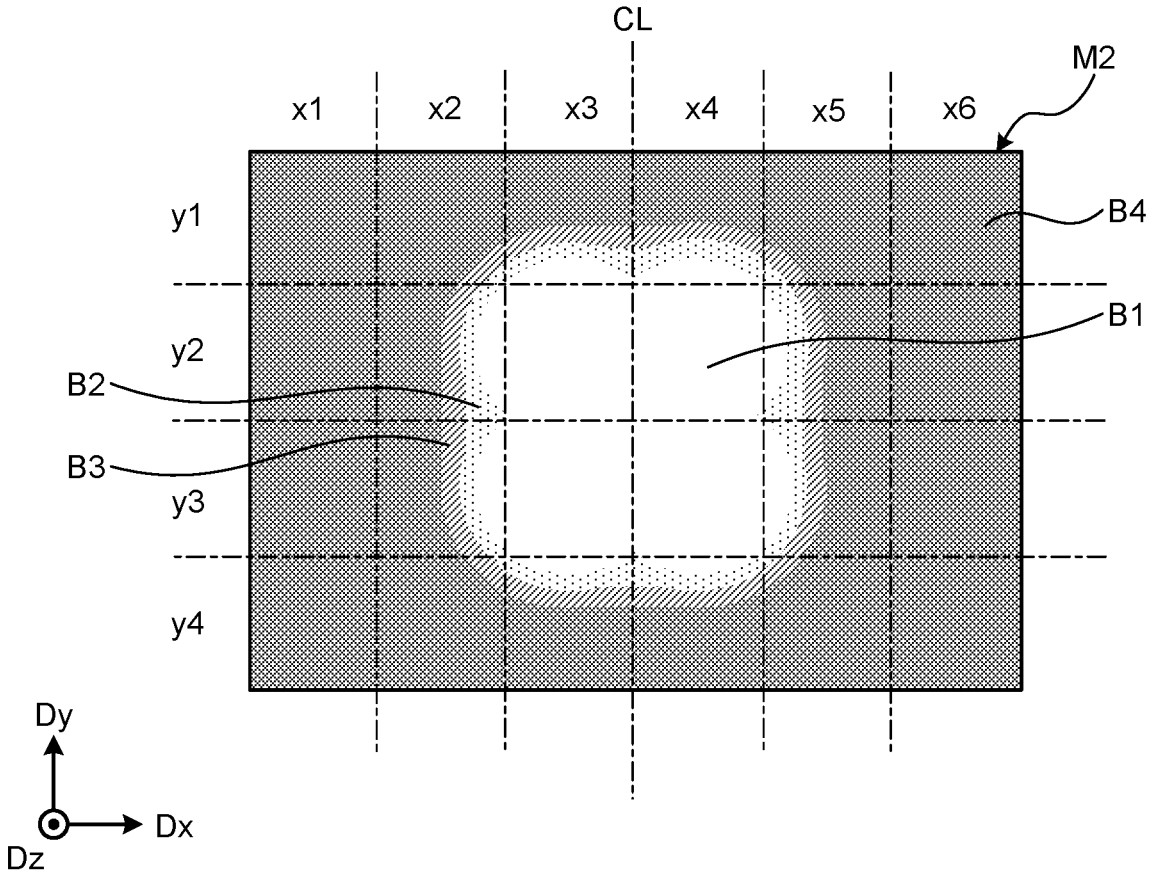
FIG. 8 is a schematic diagram illustrating an example of a luminance distribution corresponding to the low-resolution data illustrated in FIG. 7.

FIG. 8 is a schematic diagram illustrating an example of the luminance distribution M2 corresponding to the low-resolution data M1 illustrated in FIG. 7. The luminance distribution M2 illustrated in FIG. 8 includes a high-luminance portion B1, a low-luminance portion B4, and intermediate luminance portions illustrated as a first intermediate luminance portion B2 and a second intermediate luminance portion B3 in FIG. 8.

In the high-luminance portion B1, the luminance is obtained which corresponds to the light of the light source elements 62 lit up at a light emission intensity for ensuring a display output corresponding to the gradation values of the high-gradation portion LA of the low-resolution data M1. In the low-luminance portion B4, the luminance is obtained which corresponds to the light of the light source elements 62 lit up at a light emission intensity for ensuring a display output corresponding to the gradation values of the low-gradation portion DA of the low-resolution data M1.

The intermediate luminance portions are generated because the light of the light source elements 62 lit up at the light emission intensity for ensuring the display output corresponding to the gradation values of the high-gradation portion LA of the low-resolution data M1 is diffused to partial areas adjacent to the partial area overlapping the light source elements 62. FIG. 8 schematically illustrates the first intermediate luminance portion B2 located closer to the high-luminance portion B1 and the second intermediate luminance portion B3 located closer to the low-luminance portion B4, the first and the second intermediate luminance portions B2 and B3 being located between the high-luminance portion B1 and the low-luminance portion B4. The first intermediate luminance portion B2 has luminance lower than that of the high-luminance portion B1 and higher than those of the second intermediate luminance portion B3 and the low-luminance portion B4. The second intermediate luminance portion B3 has luminance lower than that of the first intermediate luminance portion B2 and higher than that of the low-luminance portion B4. The high-luminance portion B1 has luminance higher than those of the first intermediate luminance portion B2, the second intermediate luminance portion B3, and the low-luminance portion B4.

The intermediate luminance portions are actually generated in a stepless manner in accordance with continuously varying diffusion of light. However, in the luminance distribution M2 generated and managed as digital information, the level of the luminance is digitalized and changes in a multi-stepped manner.

The luminance distribution calculator 13 and the luminance distribution calculator 23 do not necessarily required to derive the luminance distribution based on the light from all the light-emitting areas (for example, the entire luminance distribution M2). The luminance distribution calculator 13 only needs to be configured to derive the luminance distribution taking into account the light from light-emitting areas emitting light that can affect the display output corresponding to the first signals. The luminance distribution calculator 23 only needs to be configured to derive the luminance distribution taking into account the light from light-emitting areas emitting light that can affect the display output corresponding to the second signals. In the case of the example illustrated in FIG. 8, the luminance distribution calculator 13 need not derive the luminance distribution at the coordinate x6 or in an area of the coordinates x5 and x6. Also, the luminance distribution calculator 23 need not derive the luminance distribution at the coordinate x1 or in an area of the coordinates x1 and x2. The luminance distribution calculator 13 and the luminance distribution calculator 23 may naturally derive the luminance distribution based on the light from all the light-emitting areas (for example, the entire luminance distribution M2).

The gradation corrector 14 serves as a first gradation corrector that corrects the gradation values indicated by the pixel signals included in the first signals based on the luminance distribution generated by the luminance distribution calculator 13. The gradation corrector 24 serves as a second gradation corrector that corrects the gradation values indicated by the pixel signals included in the second signals based on the luminance distribution generated by the luminance distribution calculator 23.

Figure 9:
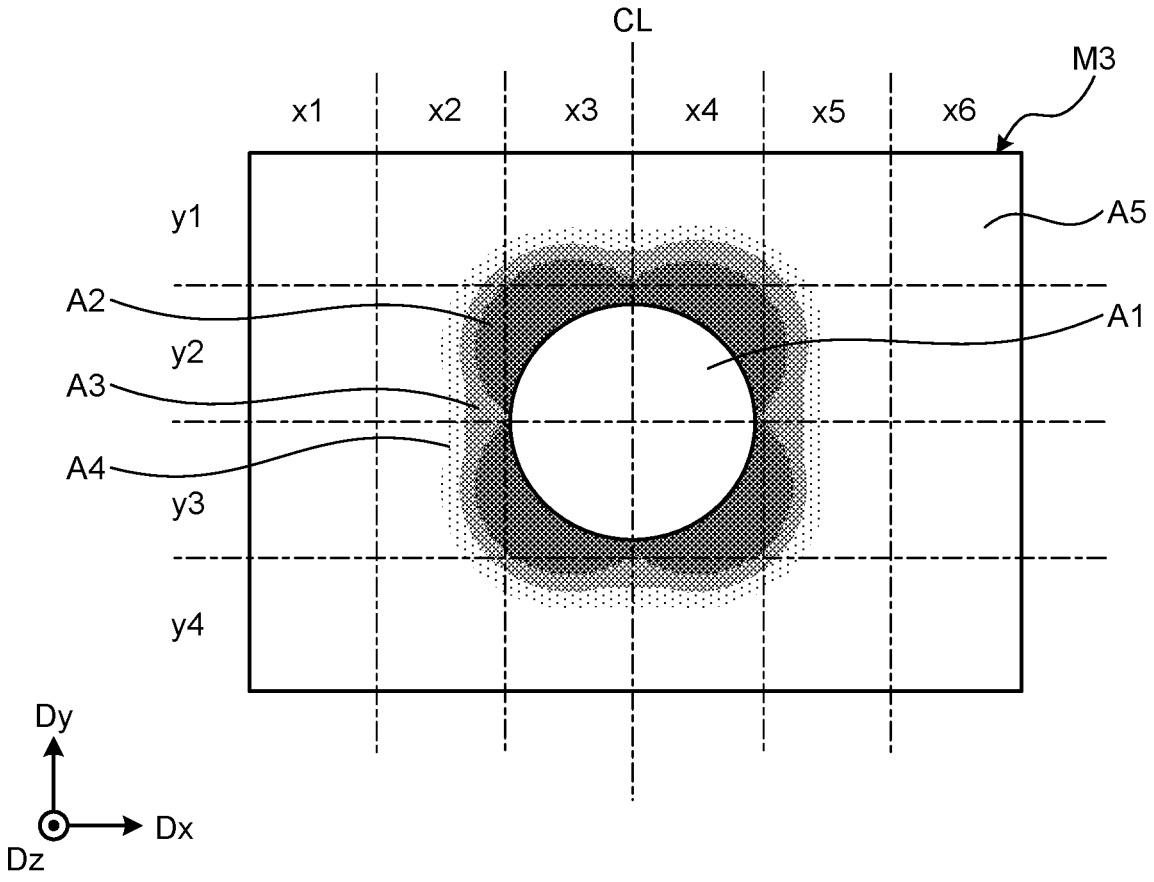
FIG. 9 is a schematic diagram illustrating an example of gradation correction performed by gradation correctors based on the image data illustrated in FIG. 6 and the luminance distribution illustrated in FIG. 8.

FIG. 9 is a schematic diagram illustrating an example of gradation correction performed by the gradation corrector 14 and the gradation corrector 24 based on the image data IM illustrated in FIG. 6 and the luminance distribution M2 illustrated in FIG. 8. A gradation correction map M3 illustrated in FIG. 9 is a map that reflects both the gradation correction of the pixel signals for the pixels VPix at the coordinates x1, x2, and x3 performed by the gradation corrector 14 and the gradation correction of the pixel signals for the pixels VPix at the coordinates x4, x5, and x6 performed by the gradation corrector 24.

The gradation correction map M3 includes a non-correction portion such as a first non-correction portion A1 and correction portions including, for example, a first gradation correction portion A2, a second gradation correction portion A3, a third gradation correction portion A4, and a fourth gradation correction portion A5.

The first non-correction portion A1 is an area including the pixels VPix in positions corresponding to the object OB (refer to FIG. 6). The pixels VPix arranged corresponding to the first non-correction portion A1 are set to have brightness corresponding to the gradation values of the object OB by light having luminance corresponding to the high-luminance portion B1 (refer to FIG. 8). Thus, the pixels VPix arranged corresponding to the first non-correction portion A1 can perform the display output corresponding to the gradation values of the object OB without correcting the received pixel signals if gradation control is performed in accordance with the pixel signals. Therefore, the gradation corrector 14 and the gradation corrector 24 do not correct the pixel signals for the pixels VPix arranged corresponding to the first non-correction portion A1. However, when the luminance of the light in the first non-correction portion A1 does not exactly correspond to the gradation values of the object OB, for the purpose of more accurate gradation control, the gradation corrector 14 corrects the pixel signals to be supplied to the pixels VPix arranged corresponding to the first non-correction portion A1 so as to perform the display output corresponding to the gradation values of the object OB.

The first gradation correction portion A2, the second gradation correction portion A3, and the third gradation correction portion A4 are areas including the pixels VPix in positions corresponding to the background BG (refer to FIG. 6). The pixels VPix arranged corresponding to the first gradation correction portion A2 receive the light having the luminance corresponding to the high-luminance portion B1 (refer to FIG. 8). The pixels VPix arranged corresponding to the second gradation correction portion A3 receive the light having the luminance corresponding to the first intermediate luminance portion B2 (refer to FIG. 8). The pixels VPix arranged corresponding to the third gradation correction portion A4 receive the light having the luminance corresponding to the second intermediate luminance portion B3 (refer to FIG. 8). The pixels VPix arranged corresponding to the fourth gradation correction portion A5 receive the light having the luminance corresponding to the gradation values of the background BG caused by the light having the luminance corresponding to the low-luminance portion B4 (refer to FIG. 8). In this way, the display output to be reproduced by the pixels VPix is uniform corresponding to the background BG throughout the first gradation correction portion A2, the second gradation correction portion A3, the third gradation correction portion A4, and the fourth gradation correction portion A5. However, the luminance of the light received by these portions differ from one another. Therefore, the gradation corrector 14 and the gradation corrector 24 correct the pixel signals for the pixels VPix arranged corresponding to the first gradation correction portion A2, the second gradation correction portion A3, the third gradation correction portion A4, and the fourth gradation correction portion A5.

Differences between the degree of correction to the pixel signals for the pixels VPix arranged corresponding to the first gradation correction portion A2, the degree of correction to the pixel signals for the pixels VPix arranged corresponding to the second gradation correction portion A3, and the degree of correction to the pixel signals for the pixels VPix arranged corresponding to the third gradation correction portion A4, correspond to differences between the luminance of the high-luminance portion B1, the luminance of the first intermediate luminance portion B2, the luminance of the second intermediate luminance portion B3, and the luminance of the low-luminance portion B4. In the case of the luminance distribution M2 illustrated in FIG. 8, the luminance of the high-luminance portion B1 is higher than the luminance of the first intermediate luminance portion B2, the second intermediate luminance portion B3, and the low-luminance portion B4. The luminance of the first intermediate luminance portion B2 is higher than those of the second intermediate luminance portion B3 and the low-luminance portion B4. The luminance of the second intermediate luminance portion B3 is higher than that of the low-luminance portion B4. However, the pixels VPix arranged corresponding to the first gradation correction portion A2, the second gradation correction portion A3, the third gradation correction portion A4, and the fourth gradation correction portion A5 are controlled to perform the display output corresponding to the gradation values of the background BG. Thus, the gradation corrector 14 and the gradation corrector 24 set the gradation values indicated by the pixel signals for the pixels VPix arranged corresponding to the first gradation correction portion A2 to values lower than the gradation values indicated by the pixel signals for the pixels VPix arranged corresponding to the second gradation correction portion A3, the third gradation correction portion A4, and the fourth gradation correction portion A5. The gradation corrector 14 and the gradation corrector 24 also set the gradation values indicated by the pixel signals for the pixels VPix arranged corresponding to the second gradation correction portion A3 to values lower than the gradation values indicated by the pixel signals for the pixels VPix arranged corresponding to the third gradation correction portion A4 and the fourth gradation correction portion A5. The gradation corrector 14 and the gradation corrector 24 further set the gradation values indicated by the pixel signals for the pixels VPix arranged corresponding to the third gradation correction portion A4 to values lower than the gradation values indicated by the pixel signals for the pixels VPix arranged corresponding to the fourth gradation correction portion A5. In FIG. 9, dot patterns are applied to the first gradation correction portion A2, the second gradation correction portion A3, and the third gradation correction portion A4 such that these portions corrected to have a lower gradation value appear closer to black.

As described above, the gradation corrector 14 and the gradation corrector 24 perform the correction processing of correcting the pixel signals required to be corrected and not correcting the pixel signals not required to be corrected. The pixel signals after being corrected by the gradation corrector 14 are supplied to the sub-pixels SPix sharing the signal lines SGL coupled to the first control circuit 10. The pixel signals after being corrected by the gradation corrector 24 are supplied to the sub-pixels SPix sharing the signal lines SGL coupled to the second control circuit 20. In the case of the example described with reference to FIGS. 6 to 9, the pixel signals in the area of the image included in the first partial image data IM1 are to be corrected by the gradation corrector 14. In this case, the pixel signals in the area of the image included in the second partial image data IM2 are to be corrected by the gradation corrector 24.

The timing adjuster 15 outputs the lighting quantity information generated by the lighting quantity calculator 12 to the light source control circuit 60. The light source control circuit 60 controls the light emission intensity of each of the light source elements 62 in accordance with the lighting quantity information. The timing adjuster 15 controls the output timing of the lighting quantity information to the light source control circuit 60. Specifically, the timing adjuster 15 controls the timing such that both the control processing of the light emission intensity of each of the light source elements 62 by the light source control circuit 60 and the correction processing of the pixel signals for determining the orientations of the sub-pixels SPix illuminated by the light from the light source element 62 lit up at the light emission intensity, are performed based on the same lighting quantity information. The timing adjuster 15 of the first control circuit 10 may synchronize the first control circuit 10 with the second control circuit 20 based on the timing at which the timing adjuster 15 receives the second low-resolution data M12 transmitted from the resolution converter 21 of the second control circuit 20 through the lighting quantity calculator 12 of the first control circuit 10. In this case, the term "synchronize" refers to the act of synchronizing the timing of outputs of the first control circuit 10 and the second control circuit 20 to the signal lines SGL, corresponding to the input timing of the first signals and the second signals constituting the image data IM. The timing of the operation of the gate driver 30 is controlled corresponding to the timing of the outputs.

The timing adjuster 15 also controls the timing of output of the drive signals from the gate driver 30, corresponding to the timing of output of the corrected pixel signals. For this purpose, the timing adjuster 15 is coupled to the gate driver 30 through the wiring 35. The component for controlling the timing of output of the drive signals from the gate driver 30 may be an independent component, such as a timing controller, different from the timing adjuster 15.

The wiring 35 may be wiring that is mounted on a substrate (for example, the first substrate 3) provided with the first control circuit 10 and the second control circuit 20, or may be coated wiring that is provided independently of the substrate. The wiring 65 is, for example, coated wiring, but may be wiring mounted on a substrate (for example, the first substrate 3) provided with the first control circuit 10 and the light source control circuit 60 when the light source control circuit 60 is provided on the same substrate as that of the first control circuit 10.

The following describes advantageous effects of the embodiment based on a comparison with a reference example. The reference example will first be described with reference to FIGS. 10, 11, and 12.

Reference Example

Figure 10:
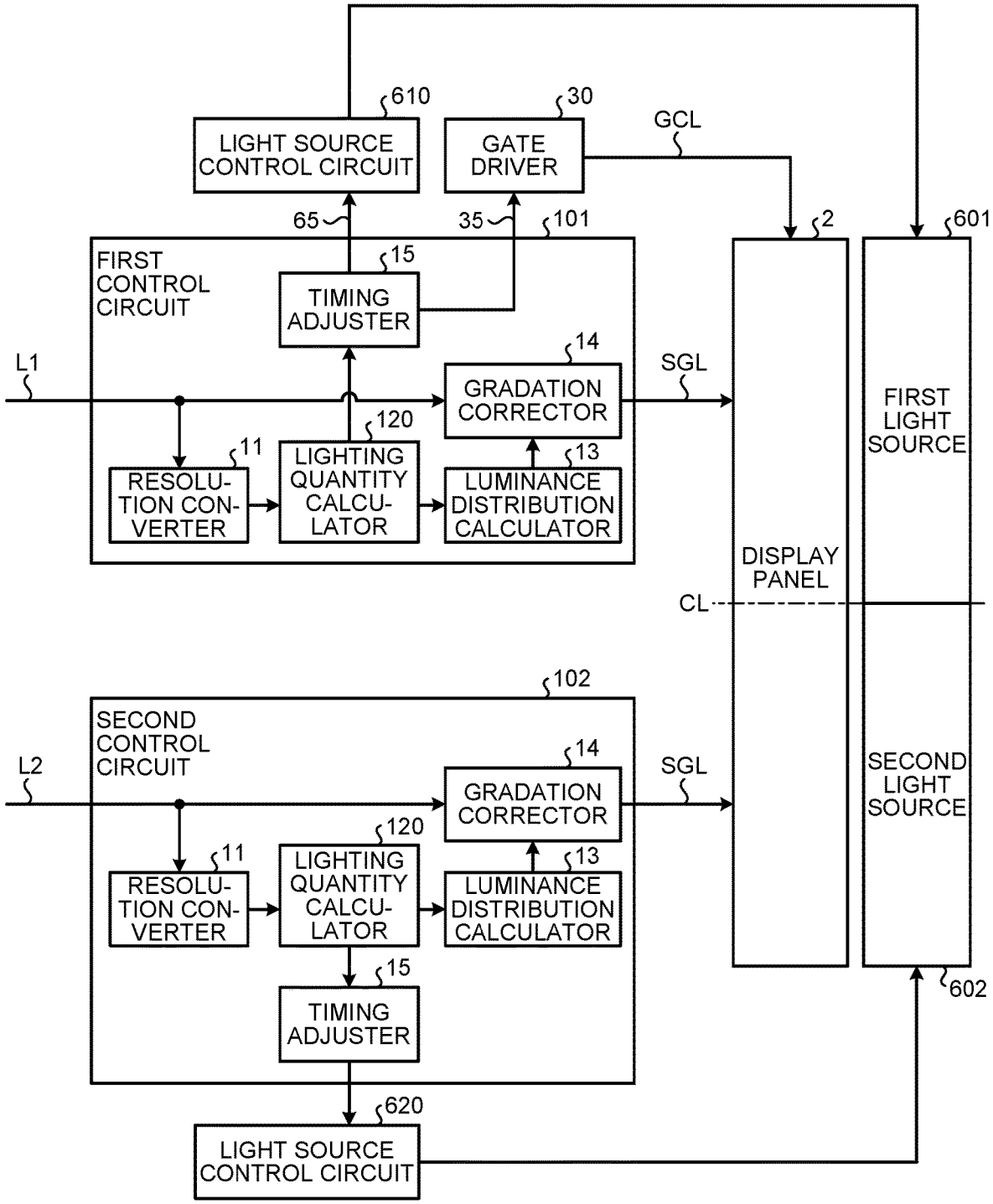
FIG. 10 is a block diagram illustrating an exemplary configuration of a reference example.

FIG. 10 is a block diagram illustrating an exemplary configuration of the reference example. The reference example includes a first control circuit 101 and a second control circuit 102 as components substituted for the first control circuit 10 and the second control circuit 20 in the embodiment. The first control circuit 101 is the same circuit as the second control circuit 102. Each of the first control circuit 101 and the second control circuit 102 includes the resolution converter 11, a lighting quantity calculator 120, the luminance distribution calculator 13, the gradation corrector 14, and the timing adjuster 15. The first control circuit 101 and the second control circuit 102 receive the first signals through the first transmission lines L1 and the second signals through the second transmission lines L2 at the same time, and are the same circuit. Therefore, the first and the second control circuits 101 and 102 automatically synchronize with each other.

The resolution converter 11 of the reference example generates the low-resolution data of the received signals. The resolution converter 11 included in the first control circuit 101 generates the first low-resolution data M11 illustrated in FIG. 7. The resolution converter 11 included in the second control circuit 102 generates the second low-resolution data M12 illustrated in FIG. 7.

The lighting quantity calculator 120 included in the first control circuit 101 generates the lighting quantity information corresponding to the first low-resolution data M11 generated by the resolution converter 11 included in the first control circuit 101. That is, the lighting quantity calculator 120 generates the lighting quantity information including lighting quantity information only for the area of the coordinates x1, x2, and x3. The lighting quantity calculator 120 included in the second control circuit 102 generates the lighting quantity information corresponding to the second low-resolution data M12 generated by the resolution converter 11 included in the second control circuit 102. That is, the lighting quantity calculator 120 generates the lighting quantity information including lighting quantity information only for the area of the coordinates x4, x5, and x6.

The luminance distribution calculator 13 included in the first control circuit 101 derives the luminance distribution corresponding to the lighting quantity information generated by the lighting quantity calculator 120 included in the first control circuit 101. That is, the lighting quantity calculator 120 derives a luminance distribution M101 including a luminance distribution only in the area of the coordinates x1, x2, and x3 from the lighting quantity information including the lighting quantity information only for the area of the coordinates x1, x2, and x3.

Figure 11:
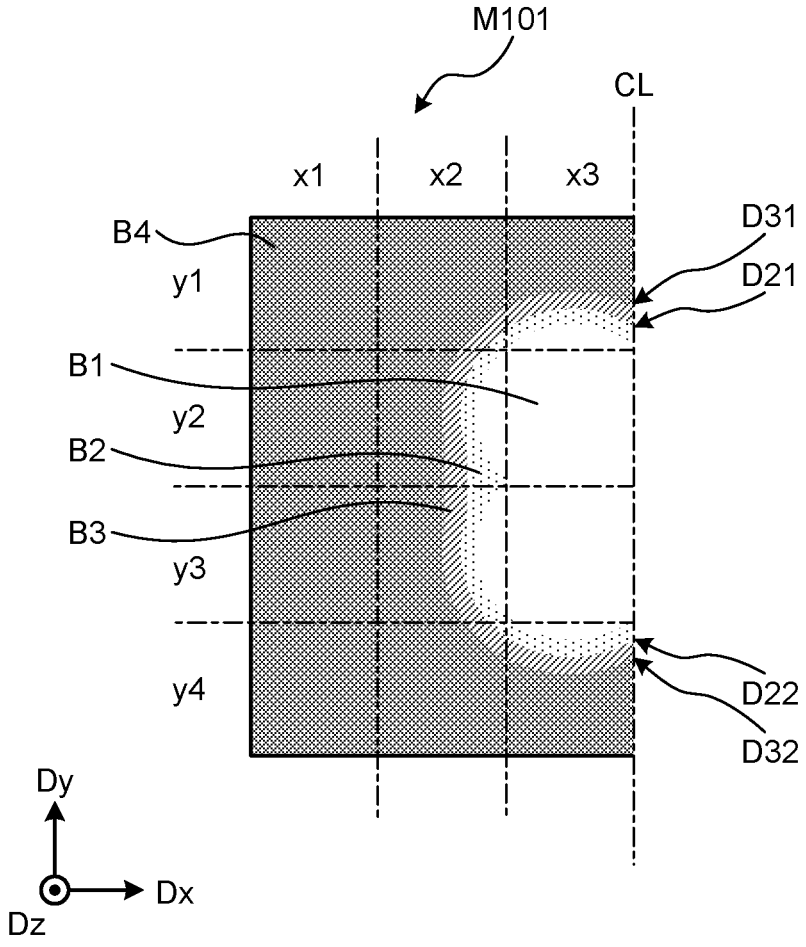
FIG. 11 is a schematic diagram illustrating an example of the luminance distribution including luminance distribution only in an area of coordinates x1, x2, and x3 derived from lighting quantity information including lighting quantity information only for the area of the coordinates x1, x2, and x3 in the reference example.

FIG. 11 is a schematic diagram illustrating an example of the luminance distribution M101 including the luminance distribution only in the area of the coordinates x1, x2, and x3 derived from the lighting quantity information including the lighting quantity information only for the area of the coordinates x1, x2, and x3 in the reference example. In the luminance distribution M101 illustrated in FIG. 11, border positions D21 and D22 and border positions D31 and D32 are depressed deeper toward the high-luminance portion B1 unlike in the area of the coordinates x1, x2, and x3 in the luminance distribution M2 illustrated in FIG. 8. The border positions D21 and D22 are border positions between the first intermediate luminance portion B2 and the second intermediate luminance portion B3 near the borderline CL. The border positions D31 and D32 are border positions between the second intermediate luminance portion B3 and the low-luminance portion B4 near the borderline CL. The reason for such positional differences in the border positions D21, D22, D31, and D32 in the reference example as compared with the embodiment is as follows: in the reference example, the luminance distribution calculator 13 derives the luminance distribution M101 from the lighting quantity information including the lighting quantity information only in the area of the coordinates x1, x2, and x3, and thus, the light emission intensity of the light source element 62 at, for example, the coordinate x4 indicated by the lighting quantity information in the area of the coordinates x4, x5, and x6 is not reflected thereto. That is, when deriving the luminance distribution at the coordinate x3, the luminance distribution calculator 13 included in the first control circuit 101 has no way of obtaining information on all the light-emitting areas emitting the light affecting the luminance at the coordinate x3. For the same reason, the luminance distribution calculator 13 does not take into account the influence of the luminance of the light coming from the light source elements 62 arranged at, for example, the coordinates (x4, y2) and (x4, y3) on the high-luminance portion B1. For this reason, the lighting quantity information is determined to ensure the luminance corresponding to the high-luminance portion B1 with the light source elements 62 in the area of the coordinates x1, x2, and x3, and thus, the high-luminance portion B1 becomes too bright when the light from the light source elements 62 arranged at the coordinates (x4, y2) and the light from (x4, y3), for example, are added thereto.

The luminance distribution calculator 13 included in the second control circuit 102 derives the luminance distribution corresponding to the lighting quantity information generated by the lighting quantity calculator 120 included in the second control circuit 102. That is, the lighting quantity calculator 120 derives the luminance distribution including the luminance distribution only in the area of the coordinates x4, x5, and x6 from the lighting quantity information including the lighting quantity information only for the area of the coordinates x4, x5, and x6.

Figure 12:
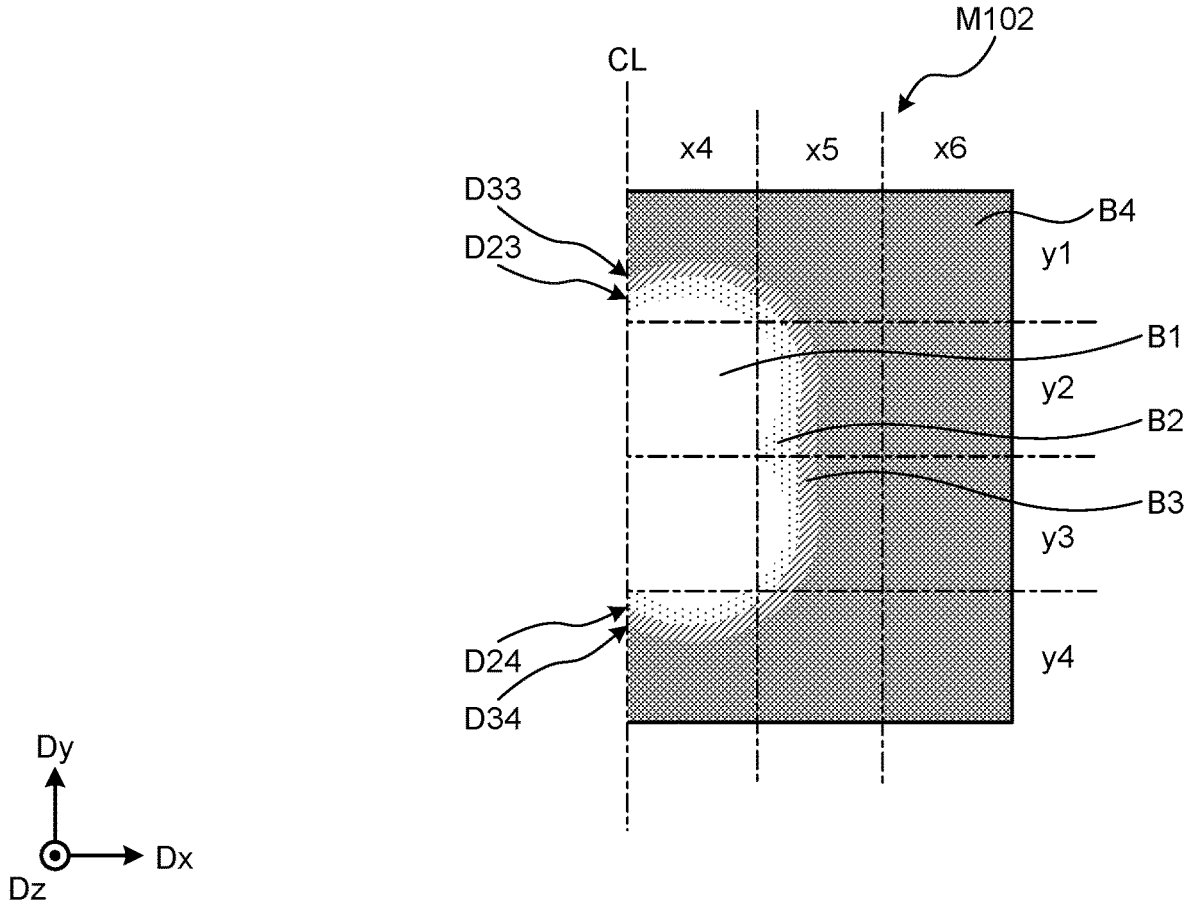
FIG. 12 is a schematic diagram illustrating an example of the luminance distribution including luminance distribution only in an area of coordinates x4, x5, and x6 derived from the lighting quantity information including lighting quantity information only for the area of the coordinates x4, x5, and x6 in the reference example.

FIG. 12 is a schematic diagram illustrating an example of a luminance distribution M102 including the luminance distribution only in the area of the coordinates x4, x5, and x6 derived from the lighting quantity information including the lighting quantity information only for the area of the coordinates x4, x5, and x6 in the reference example. In the luminance distribution M102 illustrated in FIG. 12, border positions D23 and D24 and border positions D33 and D34 are depressed deeper toward the high-luminance portion B1 unlike in the area of the coordinates x4, x5, and x6 in the luminance distribution M2 illustrated in FIG. 8. The border positions D23 and D24 are border positions between the first intermediate luminance portion B2 and the second intermediate luminance portion B3 near the borderline CL. The border positions D33 and D34 are border positions between the second intermediate luminance portion B3 and the low-luminance portion B4 near the borderline CL. The reason for such positional differences in the border positions D23, D24, D33, and D34 in the reference example as compared with the embodiment is as follows: in the reference example, the luminance distribution calculator 13 derives the luminance distribution M102 from the lighting quantity information including the lighting quantity information only for the area of the coordinates x4, x5, and x6, and thus, the light emission intensity of the light source element 62 at, for example, the coordinate x1 indicated by the lighting quantity information in the area of the coordinates x1, x2, and x3 is not reflected thereto. That is, when deriving the luminance distribution at the coordinate x4, the luminance distribution calculator 13 included in the second control circuit 102 has no way of obtaining information on all the light-emitting areas emitting the light affecting the luminance at the coordinate x4.

The luminance distribution calculator 13 of the reference example derives the luminance distributions M101 and M102 described above with reference to FIGS. 11 and 12. In contrast, the actual luminance distribution is the luminance distribution M2 illustrated in FIG. 8. That is, in the reference example, the luminance distribution different from the actual luminance distribution is derived.

The gradation corrector 14 included in the first control circuit 101 corrects the pixel signals of the first signals based on the luminance distribution information derived by the luminance distribution calculator 13 included in the first control circuit 101. The gradation corrector 14 included in the second control circuit 102 corrects the pixel signals of the second signals based on the luminance distribution information derived by the luminance distribution calculator 13 included in the second control circuit 102. However, as described above, the luminance distribution different from the actual luminance distribution is derived in the reference example. Thus, the correction processing by the gradation corrector 14 of the reference example results in inappropriate correction processing not corresponding to the actual luminance distribution. Specifically, the gradation values of the pixels VPix near the border positions D21, D22, D23, D24, D31, D32, D33, and D34 are reduced insufficiently, so that the pixels VPix are viewed as brighter than the background BG. Also, in the high-luminance portion B1, the effect of the luminance of the light coming from the light source elements 62 arranged at, for example, the coordinates (x4, y2) and (x4, y3) are not taken into account. This fact significantly affects the vicinity of the borderline CL in particular. As a result, in the vicinity of the borderline CL in the high-luminance portion B1, unintended display output is made in which the excessively bright luminance of the actual light increases the gradation in the display output to an excessively high value.

The reference example includes a first light source 601 and a second light source 602 that illuminate the display panel 2, as components substituted for the light source 6. The first light source 601 is provided so as to overlap an area of the display panel 2 corresponding to the first signals. The second light source 602 is provided so as to overlap an area of the display panel 2 corresponding to the second signals. The area corresponding to the first signals in the reference example refers to an area corresponding to the coordinates x1, x2, and x3. The area corresponding to the second signals in the reference example refers to an area corresponding to the coordinates x4, x5, and x6. A light source control circuit 610 that controls the lighting of the light source elements 62 provided in the first light source 601 and a light source control circuit 620 that controls the lighting of the light source elements 62 provided in the second light source 602 are individually provided. The timing adjuster 15 of the first control circuit 101 outputs the lighting quantity information to the light source control circuit 610 and controls the operation timing of the light source control circuit 610 and the gate driver 30. The timing adjuster 15 of the second control circuit 102 outputs the lighting quantity information to the light source control circuit 620 and controls the operation timing of the light source control circuit 620. In this way, in the reference example, the lighting quantity information is individually generated for the first signals and the second signals in an independent manner. Hence, the light sources (the first light source 601 and the second light source 602) need to be individually provided for the first control circuit 101 and the second control circuit 102.

Operational Advantages of Embodiment

In contrast, according to the embodiment, the lighting quantity calculator 12 generates the lighting quantity information on the entire light source 6 based on both the first low-resolution data M11 corresponding to the first signals and the second low-resolution data M12 corresponding to the second signals. This operation can derive the luminance distribution M2 based on the lighting quantity information on the entire light source 6. Thus, the gradation corrector 14 can perform the appropriate correction processing based on the correct luminance distribution. That is, the display device of the embodiment can obtain the display output more faithful to the image data IM. In addition, the timing adjuster 15 of the first control circuit 10 can control the operation of the light source 6 based on the lighting quantity information on the entire light source 6. As a result, the components responsible for the operation control of the light source elements 62 can be more integrated.

As described above, according to the embodiment, the display device 1 includes the display panel 2 having the display area AA with the pixels VPix arranged therein, the light source 6 that illuminates the display area AA, the first control circuit 10 that receives the first signals corresponding to a first partial image (for example, the first partial image data IM1) to be displayed in one portion of the display area AA, and the second control circuit 20 that receives the second signals corresponding to a second partial image (for example, the second partial image data IM2) to be displayed in the other portion of the display area AA. The light source 6 has the light-emitting areas in each of which the light emission intensity is individually controllable. The first control circuit 10 transmits the lighting quantity information indicating the light emission intensity of each of the light-emitting areas to the second control circuit 20. The function capable of achieving the light emission control of the light source elements is incorporated in the first control circuit 10 that transmits the lighting quantity information. As a result, the display device 1 need not be provided with a dedicated circuit for achieving the light emission control of the light source elements. In this way, the display device of the embodiment is capable of both achieving the light emission control of the light source elements and restraining the increase in the number of circuits for achieving the light emission control.

The first control circuit 10 includes the first resolution converter (the resolution converter 11) that generates first low-resolution data (for example, the first low-resolution data M11) based on the first signals, the first low-resolution data having a resolution lower than that of the first partial image (for example, the first partial image data IM1). The second control circuit 20 includes the second resolution converter (the resolution converter 21) that generates second low-resolution data (for example, the second low-resolution data M12) based on the second signals, the second low-resolution data having a resolution lower than that of the second partial image (for example, the second partial image data IM2). The second control circuit 20 transmits the second low-resolution data to the first control circuit 10. The first control circuit 10 also includes the lighting quantity calculator 12 that generates the lighting quantity information based on the first low-resolution data and the second low-resolution data, the first luminance distribution calculator (the luminance distribution calculator 13) that derives the luminance distribution (for example, the luminance distribution M2) of the light from the light source 6 based on the lighting quantity information, and the first gradation corrector (the gradation corrector 14) that corrects the gradation values indicated by the pixel signals included in the first signals based on the luminance distribution derived by the first luminance distribution calculator. The second control circuit 20 includes the second luminance distribution calculator (the luminance distribution calculator 23) that derives the luminance distribution (for example, the luminance distribution M2) of the light from the light source 6 based on the lighting quantity information and the second gradation corrector (the gradation corrector 24) that corrects the gradation values indicated by the pixel signals included in the second signals based on the luminance distribution derived by the second luminance distribution calculator. With this configuration, the first low-resolution data and the second low-resolution data can be generated by the first control circuit 10 and the second control circuit 20, respectively; the lighting quantity information can be generated by the first control circuit 10; and the derivation of the luminance distribution and the correction of the gradation values based on the first low-resolution data and the derivation of the luminance distribution and the correction of the gradation values based on the second low-resolution data can be performed separately. Accordingly, input and output signal terminals corresponding to the number of the pixels VPix provided in the display area AA can be distributed to the first control circuit 10 and the second control circuit 20 so as to restrain the increase in the number of the terminals in each of the circuits. The increase in the number of the terminals in each of the circuits causes an increase in size of the circuits. Therefore, the embodiment can facilitate a reduction in size of the first control circuit 10 and the second control circuit 20.

In a configuration, such as those of the first control circuit 10 and the second control circuit 20, in which some pieces of image data (for example, the first partial image data IM1 or the second partial image data IM2) are received, an unillustrated circuit, such as a differential circuit or an interface circuit, is provided as a component for dealing with such data input. An increase in the data received by one circuit causes an increase in size of the unillustrated circuit and an increase in size of a component having the unillustrated circuit. In contrast, in the embodiment, the image data (for example, the image data IM) is distributed to and received by the first control circuit 10 and the second control circuit 20. Therefore, the embodiment can restrain the increase in size of the unillustrated circuit in each of the first control circuit 10 and the second control circuit 20, and the increase in size of each of the first control circuit 10 and the second control circuit 20.

In addition, even in a configuration, such as those of the first control circuit 10 and the second control circuit 20, provided with a plurality of circuits that output the pixel signals to the pixels VPix in response to the external input of the image data (for example, the image data IM), the display device of the embodiment can appropriately derive the luminance distribution corresponding to the diffusion of the light from the light source elements 62 for achieving the above-mentioned uniformity and can appropriately correct the gradations.

Modifications

Figure 13:
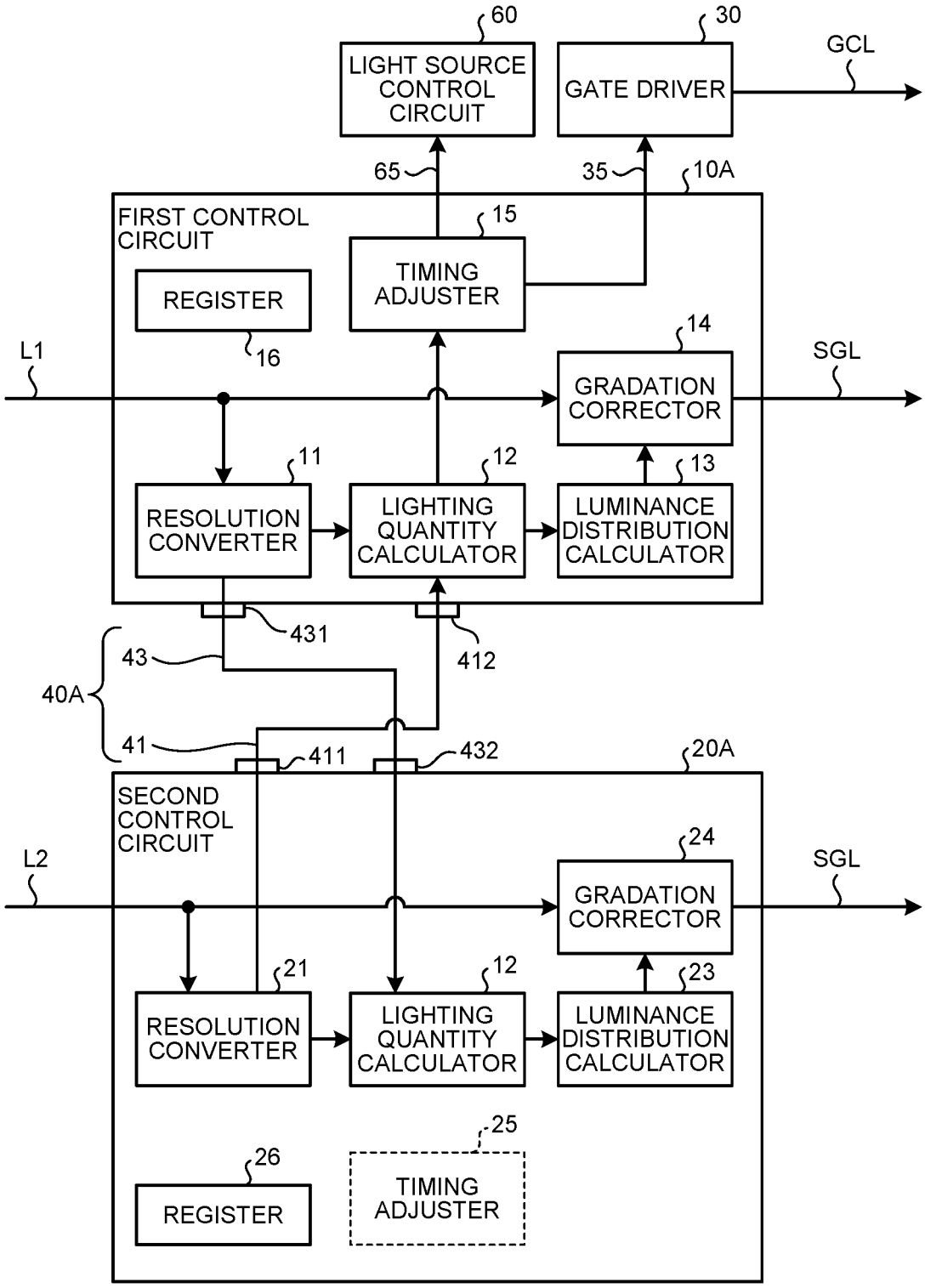
FIG. 13 is a block diagram illustrating an exemplary specific configuration of a first control circuit and a second control circuit, and an exemplary coupling relation between the first control circuit and the second control circuit according to a first modification of the embodiment.
Figure 14:
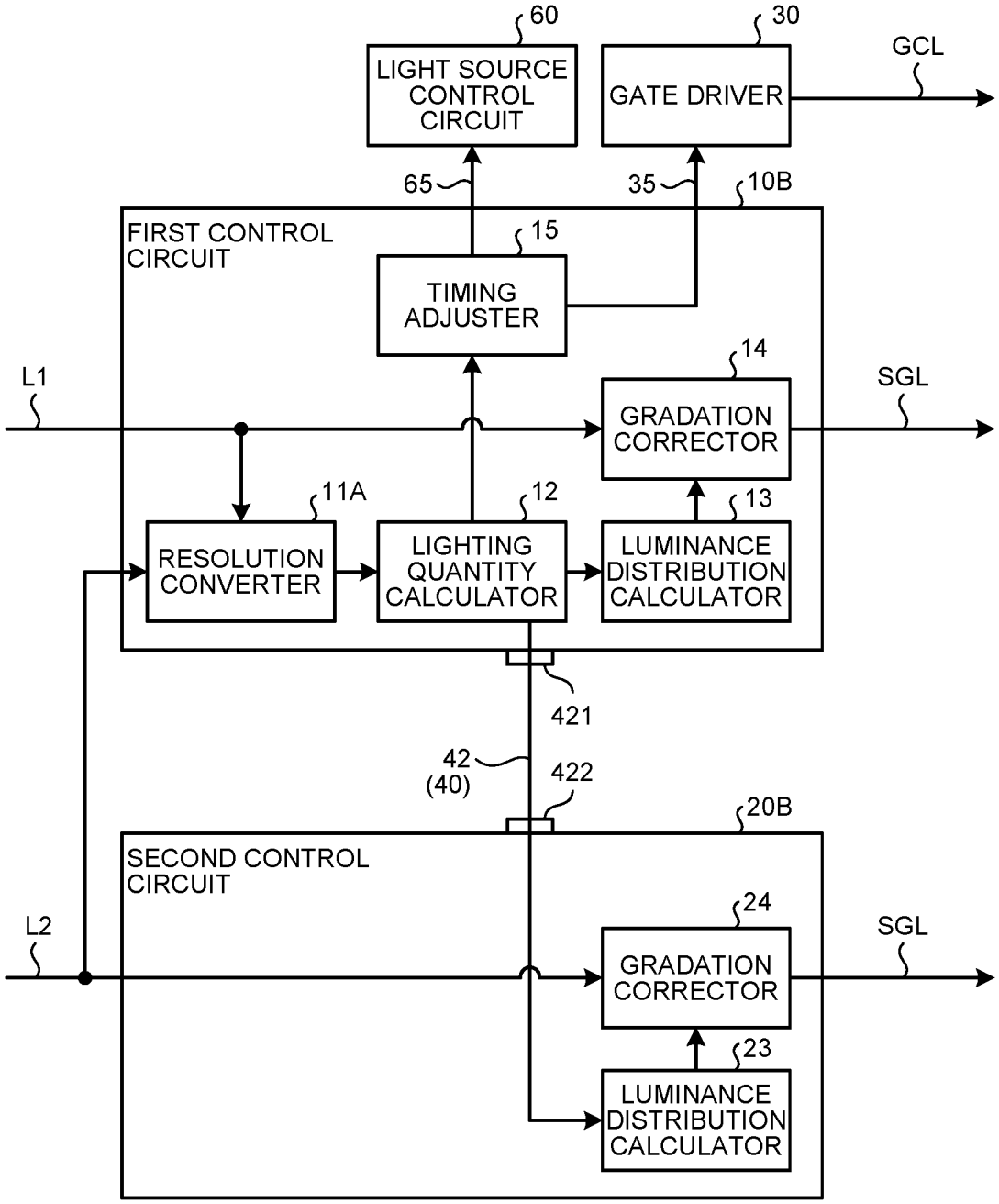
FIG. 14 is a block diagram illustrating an exemplary specific configuration of a first control circuit and a second control circuit, and an exemplary coupling relation between the first control circuit and the second control circuit according to a second modification of the embodiment.
Figure 15:
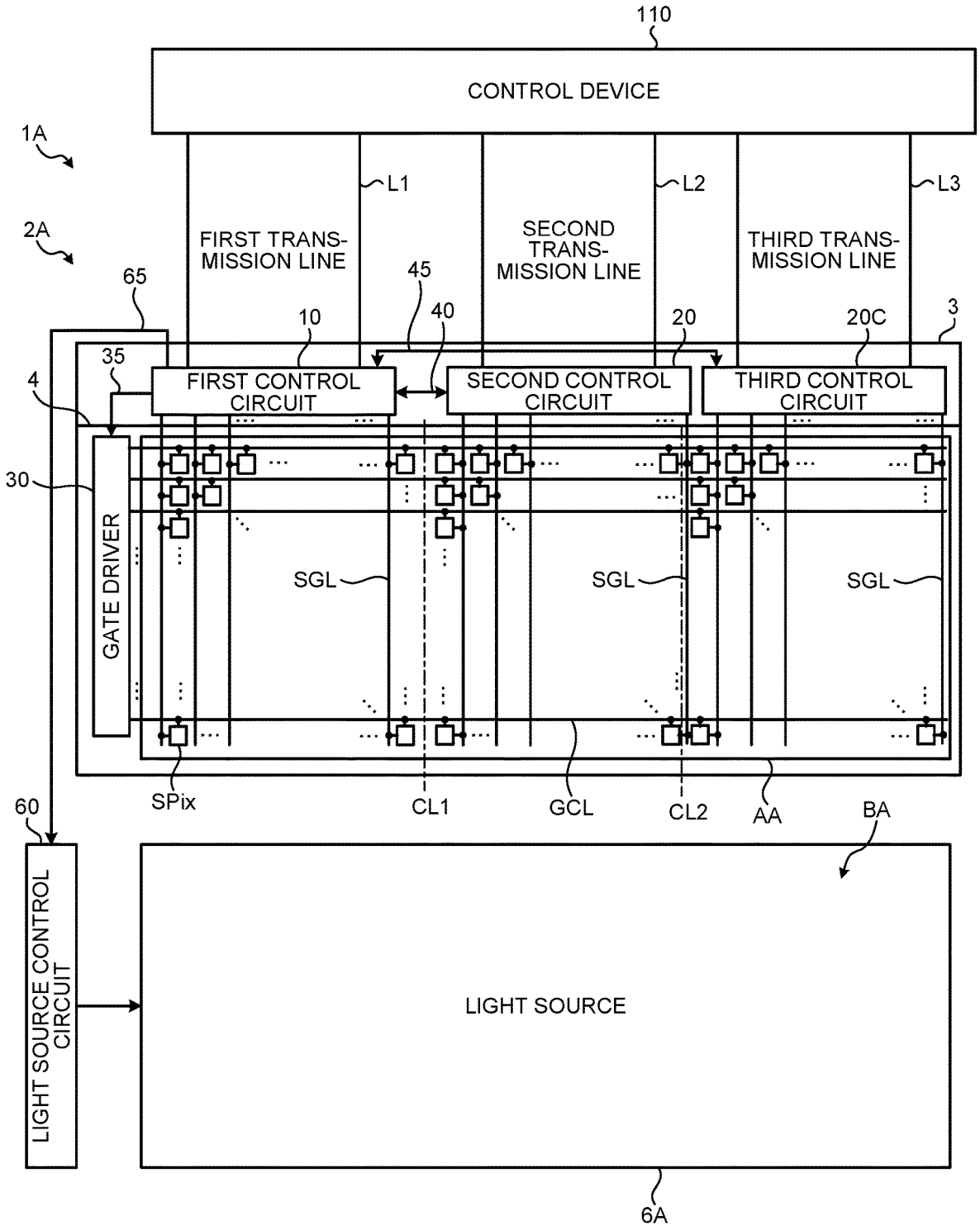
FIG. 15 is a schematic diagram illustrating an exemplary main configuration of a display device according to a third modification of the embodiment.

The following describes modifications of the embodiment that have configurations partially different from the configuration of the embodiment, with reference to FIGS. 13, 14, and 15.

First Modification

FIG. 13 is a block diagram illustrating an exemplary specific configuration of a first control circuit 10A and a second control circuit 20A, and an exemplary coupling relation between the first control circuit 10A and the second control circuit 20A according to a first modification of the embodiment. The display device of the first modification includes the first control circuit 10A instead of the first control circuit 10 included in the display device of the embodiment. The display device of the first modification includes the second control circuit 20A instead of the second control circuit 20 included in the display device of the embodiment. The display device of the first modification includes a transmission portion 40A instead of the transmission portion 40 included in the display device of the embodiment. The transmission portion 40A includes a third transmission portion 43 instead of the second transmission portion 42 in the embodiment. The transmission portion 40A includes the first transmission portion 41. The specific configuration of the transmission portion 40A including the first transmission portion 41 and the third transmission portion 43 is the same as that of the transmission portion 40 of the embodiment.

The second control circuit 20A includes the lighting quantity calculator 12 in addition to the configuration of the second control circuit 20. The resolution converter 11 of the first control circuit 10A has a function to transmit the first low-resolution data M11 to the lighting quantity calculator 12 of the second control circuit 20A in addition to the function described in the embodiment. The first low-resolution data M11 to be transmitted is output from a terminal 431 of the second control circuit 20A. The terminal 431 is coupled to a terminal 432 of the second control circuit 20A. The third transmission portion 43 couples the terminal 431 to the terminal 432.

As described above, the first control circuit 10A of the first modification includes the terminal 431 for outputting the first low-resolution data M11 to the second control circuit 20A. The terminal 431 serves as the first output terminal of the first modification. The first control circuit 10A includes the terminal 432 for receiving the second low-resolution data M12. The terminal 432 serves as the second input terminal of the first modification.

In the same way as the lighting quantity calculator 12 of the embodiment, the lighting quantity calculator 12 of the second control circuit 20A generates the lighting quantity information based on the first low-resolution data M11 and the second low-resolution data M12. Specifically, the lighting quantity calculator 12 of the second control circuit 20A generates the lighting quantity information based on the first low-resolution data M11 transmitted from the first control circuit 10A and the second low-resolution data M12 generated by the resolution converter 11 of the second control circuit 20A. The luminance distribution calculator 23 of the second control circuit 20A is the same as the luminance distribution calculator 23 of the embodiment except that the luminance distribution calculator 23 of the second control circuit 20A derives the luminance distribution M2 based on the lighting quantity information generated by the lighting quantity calculator 12 of the second control circuit 20A.

The lighting quantity calculator 12 included in the first control circuit 10A of the first modification is the same as the lighting quantity calculator 12 of the embodiment except that the lighting quantity calculator 12 of the first modification does not transmit the lighting quantity information to the second control circuit 20A. Thus, the first modification does not include the terminal 421, the terminal 422, and the second transmission portion 42 that are provided as components for transmitting the lighting quantity information from the first control circuit 10 to the second control circuit 20 in the embodiment. That is, in the first modification, the lighting quantity calculator 12 included in each of the first control circuit 10A and the second control circuit 20A generates the lighting quantity information.

The second control circuit 20A further includes a timing adjuster 25. The timing adjuster 15 and the timing adjuster 25 have the functionally same configuration. The first control circuit 10A further includes a register 16. The second control circuit 20A further includes a register 26. The register 16 stores therein an on-off setting value for the function of the timing adjuster 15. The timing adjuster 15 of the first control circuit 10A operates when the setting value of the register 16 is "on", and does not operate when the setting value thereof is "off". The register 26 stores therein an on-off setting value for the function of the timing adjuster 25. The timing adjuster 25 operates when the setting value of the register 26 is "on", and does not operate when the setting value thereof is "off". FIG. 13 illustrates a case where the timing adjuster 15 is in operation, and the timing adjuster 25 is not in operation. In FIG. 13, a rectangle representing the timing adjuster 25 drawn with a dashed line represents that the timing adjuster 25 is not in operation. That is, in the configuration illustrated in FIG. 13, the timing adjuster 15 operates to perform the same processing as that of the embodiment described above.

The timing adjuster 15 may be kept from operating, and the timing adjuster 25 may be operated. In that case, the timing adjuster 25 performs the function that is performed by the timing adjuster 15 in the embodiment. The setting values of the register 16 and the register 26 are provided so as to be rewritable by an unillustrated external writing device. The function as the writing device may be included in, for example, the control device 110, or may be performed by a dedicated writing device.

The first control circuit 10A is the same as the first control circuit 10, and the second control circuit 20A is the same as the second control circuit 20, except in the respects otherwise described above. The display device of the first modification is the same as the display device 1 of the embodiment, except in the difference between the first control circuit 10A and the first control circuit 10 described above, and in the difference between the second control circuit 20A and the second control circuit 20 described above. In the same way as in the embodiment, the timing adjuster 15 of the first control circuit 10A may synchronize the first control circuit 10A with the second control circuit 20A based on the timing at which the timing adjuster 15 receives the second low-resolution data M12 transmitted from the resolution converter 21 of the second control circuit 20A through the lighting quantity calculator 12 of the first control circuit 10A. In this case, the term "synchronize" refers to the act of synchronizing the timing of outputs of the first control circuit 10A and the second control circuit 20A to the signal lines SGL, corresponding to the input timing of the first signals and the second signals constituting the image data IM. The timing of the operation of the gate driver 30 is controlled corresponding to the timing of the outputs.

The display device of the first modification includes the display panel 2 having the display area AA with the pixels VPix arranged therein, the light source 6 that illuminates the display area AA, the first control circuit 10A that receives the first signals corresponding to the first partial image (for example, the first partial image data IM1) to be displayed in one portion of the display area AA, and the second control circuit 20A that receives the second signals corresponding to the second partial image (for example, the second partial image data IM2) to be displayed in the other portion of the display area AA. The light source 6 has the light-emitting areas in each of which the light emission intensity is individually controllable. The first control circuit 10A includes the first resolution converter (the resolution converter 11) that generates the first low-resolution data (for example, the first low-resolution data M11) based on the first signals, the first low-resolution data having a resolution lower than that of the first partial image. The first control circuit 10A transmits the first low-resolution data to the second control circuit 20A. The second control circuit 20A includes the second resolution converter (the resolution converter 21) that generates the second low-resolution data (for example, the second low-resolution data M12) based on the second signals, the second low-resolution data having a resolution lower than that of the second partial image. The second control circuit 20A transmits the second low-resolution data to the first control circuit 10A. The first control circuit 10A includes a first lighting quantity calculator (the lighting quantity calculator 12) that generates the lighting quantity information based on the first low-resolution data and the second low-resolution data, the lighting quantity information indicating the light emission intensity of each of the light-emitting areas; the first luminance distribution calculator (the luminance distribution calculator 13) that derives the luminance distribution (for example, the luminance distribution M2) of the light from the light source 6 based on the lighting quantity information generated by the first lighting quantity calculator; and the first gradation corrector (the gradation corrector 14) that corrects the gradation values indicated by the pixel signals included in the first signals based on the luminance distribution derived by the first luminance distribution calculator. The second control circuit 20A includes a second lighting quantity calculator (the lighting quantity calculator 12) that generates the lighting quantity information based on the first low-resolution data and the second low-resolution data; the second luminance distribution calculator (the luminance distribution calculator 23) that derives the luminance distribution (for example, the luminance distribution M2) of the light from the light source 6 based on the lighting quantity information generated by the second lighting quantity calculator; and the second gradation corrector (the gradation corrector 24) that corrects the gradation values indicated by the pixel signals included in the second signals based on the luminance distribution derived by the second luminance distribution calculator. With this configuration, in the same way as the embodiment, the display device of the first modification can appropriately derive the luminance distribution corresponding to the diffusion of the light from the light source elements 62 for achieving the above-mentioned uniformity and can appropriately correct the gradations.

In addition, the first modification can turn on and off the functions of the timing adjuster 15 and the timing adjuster 25 corresponding to the setting values of register 16 and the register 26, respectively. Hence, the first control circuit 10A and the second control circuit 20A can have the same functional configuration. As a result, a plurality of circuits of a single type that serve as the first control circuit 10A and the second control circuit 20A can be manufactured and employed as the first control circuit 10A and the second control circuit 20A, and thus, manufacturing economies of scale such as reduction in cost of the first control circuit 10A and the second control circuit 20A can be expected.

Second Modification

FIG. 14 is a block diagram illustrating an exemplary specific configuration of a first control circuit 10B and a second control circuit 20B, and an exemplary coupling relation between the first control circuit 10B and the second control circuit 20B according to a second modification of the embodiment. The display device of the second modification includes the first control circuit 10B instead of the first control circuit 10 included in the display device of the embodiment. The display device of the second modification includes the second control circuit 20B instead of the second control circuit 20 included in the display device of the embodiment. The transmission portion 40 of the second modification does not include the first transmission portion 41 and includes the second transmission portion 42.

The first control circuit 10B includes a resolution converter 11A instead of the resolution converter 11. The resolution converter 11A receives both the first signals and the second signals. Thus, both the first transmission lines L1 and the second transmission lines L2 are coupled to the resolution converter 11A, as illustrated in FIG. 14. The resolution converter 11A generates the low-resolution data M1 based on the first signals and the second signals. That is, the resolution converter 11A has the functions of both the resolution converter 11 and the resolution converter 21 of the embodiment. Instead, the second control circuit 20B does not include the resolution converter 21, which is one of the components included in the second control circuit 20. The display device of the second modification also does not include the terminal 411, the terminal 412, and the first transmission portion 41 for transmitting the second low-resolution data M12 from the second control circuit 20 to the first control circuit 10. The lighting quantity calculator 12 included in the first control circuit 10B generates the lighting quantity information based on the low-resolution data M1 generated by the resolution converter 11A.

The first control circuit 10B is the same as the first control circuit 10, and the second control circuit 20B is the same as the second control circuit 20, except in the respects otherwise described above. The display device of the second modification is the same as the display device 1 of the embodiment, except in the difference between the first control circuit 10B and the first control circuit 10 described above, and in the difference between the second control circuit 20B and the second control circuit 20 described above.

The display device of the second modification includes the display panel 2 having the display area AA with the pixels VPix arranged therein, the light source 6 that illuminates the display area AA, the first control circuit 10B that receives the first signals corresponding to the first partial image (for example, the first partial image data IM1) to be displayed in one portion of the display area AA, and the second control circuit 20B that receives the second signals corresponding to the second partial image (for example, the second partial image data IM2) to be displayed in the other portion of the display area AA. The first control circuit 10B receives the first signals and the second signals. The first control circuit 10B includes the resolution converter (the resolution converter 11A) that generates the low-resolution data (for example, the low-resolution data M1) based on the first signals and the second signals, the low-resolution data having a resolution lower than that of the image to be displayed in the display area; the lighting quantity calculator (the lighting quantity calculator 12) that generates the lighting quantity information based on the low-resolution data; the first luminance distribution calculator (the luminance distribution calculator 13) that derives the luminance distribution (for example, the luminance distribution M2) of the light from the light source 6 based on the lighting quantity information; and the first gradation corrector (the gradation corrector 14) that corrects the gradation values indicated by the pixel signals included in the first signals based on the luminance distribution derived by the first luminance distribution calculator. The second control circuit 20B includes the second luminance distribution calculator (the luminance distribution calculator 23) that derives the luminance distribution (for example, the luminance distribution M2) of the light from the light source 6 based on the lighting quantity information, and the second gradation corrector (the gradation corrector 24) that corrects the gradation values indicated by the pixel signals included in the second signals based on the luminance distribution derived by the second luminance distribution calculator. With this configuration, in the same way as the embodiment, the display device of the second modification can appropriately derive the luminance distribution corresponding to the diffusion of the light from the light source elements 62 for achieving the above-mentioned uniformity and can appropriately correct the gradations. The circuit scale of the second control circuit 20B can be made smaller than that of the second control circuit 20.

Third Modification

FIG. 15 is a schematic diagram illustrating an exemplary main configuration of a display device 1A according to a third modification of the embodiment. A display panel 2A further includes a third control circuit 20C in addition to the various components included in the display panel 2 of the embodiment. As illustrated in FIG. 15, the signal lines SGL included in the display panel 2A are coupled to the first control circuit 10, the second control circuit 20, and the third control circuit 20C.

In the same way as the second control circuit 20, the third control circuit 20C supplies the pixel signals to the sub-pixels SPix through the signal lines SGL. The third control circuit 20C illustrated in FIG. 15 supplies the pixel signals to the sub-pixels SPix in response to third signals supplied through third transmission lines L3 from the control device 110. The third signals are signals to cause the display device 1A to display an image to be displayed in an area of the display area AA, and, in the area, pixels VPix different from the pixels VPix corresponding to the first signals and the second signals are arranged. Each of the pixels VPix in the area is made up of a plurality of the sub-pixels SPix that share a corresponding one of the scan lines GCL coupled to the gate driver 30.

The functional configuration of the third control circuit 20C is, for example, the same as that of the second control circuit 20. The third control circuit 20C is coupled to the first control circuit 10 through a transmission portion 45. The transmission portion 45 has the same configuration as that of the transmission portion 40 except that the transmission portion 45 couples the first control circuit 10 to the third control circuit 20C instead of to the second control circuit 20. That is, in the third modification, the low-resolution data and the lighting quantity information are transmitted between the third control circuit 20C and the first control circuit 10 in the same way as the transmission of the low-resolution data and the lighting quantity information between the second control circuit 20 and the first control circuit 10 in the embodiment. In other words, the third control circuit 20C is the same as the second control circuit 20 except that the arrangement positions of the sub-pixels SPix coupled thereto differ from those of the sub-pixels SPix coupled to the second control circuit 20, and the second signals are replaced with the third signals. FIG. 15 illustrates a borderline CL1 between the sub-pixels SPix supplied with the pixel signals by the first control circuit 10 and the sub-pixels SPix supplied with the pixel signals by the second control circuit 20, and illustrates a borderline CL2 between the sub-pixels SPix supplied with the pixel signals by the second control circuit 20 and the sub-pixels SPix supplied with the pixel signals by the third control circuit 20C.

Although FIG. 15 illustrates the configuration in which the three control circuits of the first control circuit 10, the second control circuit 20, and the third control circuit 20C are provided, four or more control circuits may be provided. In the case where the number (p) of the control circuits is four or more, the first control circuit 10 and (p−1) second control circuits 20 are provided. The (p−1) second control circuits 20 are individually coupled to the first control circuit 10 using the same coupling method as used in the coupling through the transmission portion 40 described above. The arrangement positions of the sub-pixels SPix coupled to the (p−1) second control circuits 20 differ between the (p−1) second control circuits 20, and the signals received from the control device 110 correspond to the arrangement positions.

A light source 6A of the third modification is the same as the light source 6 except that the size and shape of the light-emitting portion BA correspond to those of the display area AA of the display panel 2A. The display device 1A is the same as the display device 1 except in the respects otherwise described above.

Fourth Modification

Figure 16:
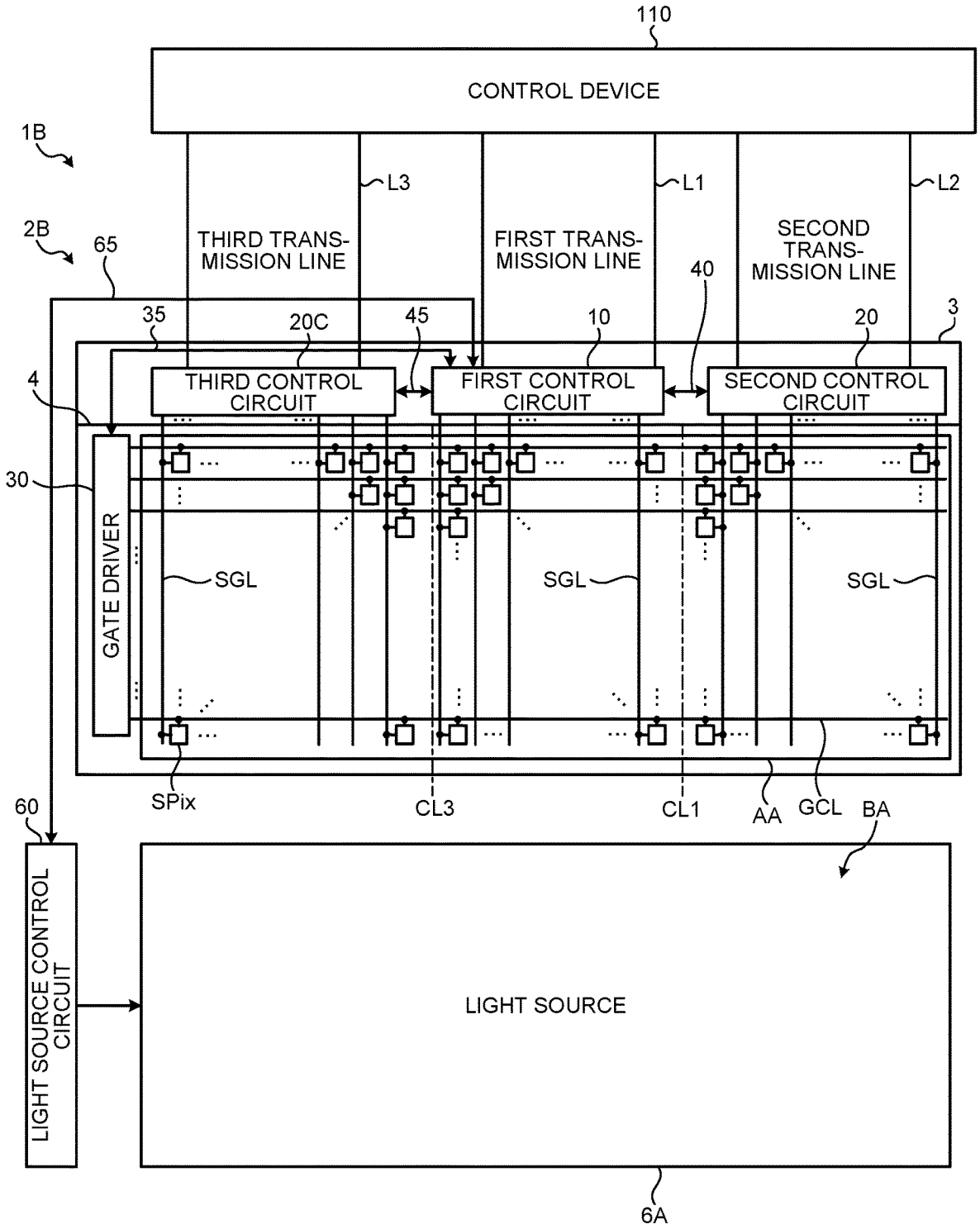
FIG. 16 is a schematic diagram illustrating an exemplary main configuration of a display device according to a fourth modification of the embodiment.

FIG. 16 is a schematic diagram illustrating an exemplary main configuration of a display device 1B according to a fourth modification of the embodiment. The display device 1B has a configuration obtained by changing the arrangement of the third control circuit 20C in the display device 1A. Specifically, as illustrated in FIG. 16, the first control circuit 10 of the fourth modification is disposed between the second control circuit 20 and the third control circuit 20C in the extending direction of the scan lines GCL. This arrangement can make the transmission portion 45 of the fourth modification shorter than that of the third modification, and thus, the wiring can be more easily provided. FIG. 16 illustrates the borderline CL1 between the sub-pixels SPix supplied with the pixel signals by the first control circuit 10 and the sub-pixels SPix supplied with the pixel signals by the second control circuit 20, and illustrates a borderline CL3 between the sub-pixels SPix supplied with the pixel signals by the first control circuit 10 and the sub-pixels SPix supplied with the pixel signals by the third control circuit 20C.

In the display device provided with the first control circuit 10 and three or more of the second control circuits 20, if the number of the second control circuits 20 is an odd number, that is, if the sum of the number of the first control circuit 10 and the number of the second control circuits 20 is an even number, the first control circuit 10 is preferably disposed near the center line of the display area AA in the extending direction of the scan lines GCL. This arrangement can make the transmission portions 40 and 45 for coupling the first control circuit 10 to the second control circuits 20 shorter in the same way as in the fourth modification, and thus, the wiring can be more easily provided. In the display device provided with the first control circuit 10 and three or more of the second control circuits 20, if the number of the second control circuits 20 is an even number, that is, if the sum of the number of the first control circuit 10 and the number of the second control circuits 20 is an odd number, the first control circuit 10 is preferably disposed in a position overlapping the center line of the display area AA in the extending direction of the scan lines GCL. This arrangement can make the transmission portions 40 and 45 for coupling the first control circuit 10 to the second control circuits 20 shorter in the same way as in the fourth modification, and thus, the wiring can be more easily provided. As described above, the first control circuit 10 is preferably disposed between the second control circuit 20 and the third control circuit 20C.

The third modification, the fourth modification, and a configuration provided with the second control circuits 20 under the same concept as that of the third modification and the fourth modification can be combined with the first modification or the second modification. That is, the first control circuit 10 and the second control circuit 20 illustrated in FIGS. 15 and 16 can be replaced with the first control circuit 10A and the second control circuit 20A or the first control circuit 10B and the second control circuit 20B. In this case, the third control circuit 20C is equivalent to a component (the second control circuit 20A or the second control circuit 20B) that replaces the second control circuit 20. The transmission portion 40 and transmission portion 45 are replaced with the transmission portion 40A or the transmission portion 40 of the second modification. If the first control circuit 10 is replaced with the first control circuit 10B, the first control circuit 10B receives all of the first signals, the second signals, the third signals, and so forth received from the control device 110. If the second control circuit 20 is replaced with the second control circuits 20A, each of the control circuits (the first control circuit 10A and the second control circuits 20A) is configured to obtain the information from the resolution converters of all the other control circuits. If the second control circuits 20 are replaced with the second control circuits 20B, the first control circuit 10B is configured to transmit the calculation result of the lighting quantity calculator 12 to the luminance distribution calculators 23 of all the other second control circuits 20B.

Others

Each of the first control circuit 10 and the second control circuit 20 may further have functions to adjust the brightness and the dynamic range of the image output to be displayed. Examples of such functions include a function to add white components to the pixel signals to boost the luminance and a function to adjust the dynamic range to, for example, what is called a high dynamic range (HDR). Such functions may be incorporated in the lighting quantity calculator 12 and the gradation corrector 14, or a dedicated functional block may be added to the first control circuit 10 and the second control circuit 20, or the components of each of the modifications that replace the first control circuit 10 and the second control circuit 20.

The specific configuration of the gate driver 30 is not limited to those illustrated in FIGS. 1 and 15. For example, the scan lines GCL may be divided at the borderline CL in FIG. 1, and the gate driver 30 coupled to the scan lines GCL in one of the divided areas and the gate driver 30 coupled to the scan lines GCL in the other of the divided areas may be individually provided. The configuration provided with the two gate drivers 30 in this way may be applied to the third modification illustrated in FIG. 15. The function of the gate driver 30 may be incorporated in the first control circuit 10. In that case, the scan lines GCL are coupled to the first control circuit 10.

Although the above-described pixel VPix is constituted by the sub-pixels SPix for red (R), green (G), and blue (B), the specific configuration of the pixel VPix is not limited thereto. The pixel VPix may further include sub-pixels SPix for other colors such as white (W) and yellow (Y). The pixel VPix may be configured to reproduce colors in a combination of colors other than red (R), green (G), and blue (B). The pixel VPix may be a monochromatic pixel.

The image data IM illustrated in FIG. 6, the low-resolution data M1 corresponding to the image data IM, the lighting quantity information, the luminance distribution M2, and the gradation correction (refer to the gradation correction map M3) are merely examples, and the present disclosure is not limited thereto. The specific content (image) of the received image data is optional, and the specific content of the low-resolution data M1, the lighting quantity information, the luminance distribution M2, and the gradation correction corresponds to the specific content of the received image data.

Other operational effects accruing from the aspects described in the embodiment of the present disclosure that are obvious from the description herein, or that are conceivable as appropriate by those skilled in the art will naturally be understood as accruing from the present disclosure.

What is claimed is:

1. A display device comprising:

a display panel that has a display area in which a plurality of pixels are arranged;

a light source configured to illuminate the display area;

a first control circuit configured to receive first signals corresponding to a first partial image to be displayed in a portion of the display area; and a second control circuit configured to receive second signals corresponding to a second partial image to be displayed in another portion of the display area, wherein the light source has a plurality of light-emitting areas in each of which a light emission intensity is individually controllable, and the first control circuit is configured to transmit lighting quantity information to control the light emission intensity of each of the light-emitting areas to the second control circuit, the lighting quantity information being based on:

first low-resolution data based on the first signals, the first low-resolution data having a resolution lower than that of the first partial image; and second low-resolution data based on the second signals, the second low-resolution data having a resolution lower than that of the second partial image.

2. The display device according to claim 1, wherein the first control circuit is configured to receive the first signals and the second signals, the first control circuit comprises a resolution converter configured to generate low-resolution data based on the first signals and the second signals, the low-resolution data having a resolution lower than that of an image to be displayed in the display area, a lighting quantity calculator configured to generate the lighting quantity information based on the low-resolution data, a first luminance distribution calculator configured to derive a luminance distribution of light from the light source based on the lighting quantity information, and a first gradation corrector configured to correct gradation values indicated by pixel signals included in the first signals based on the luminance distribution derived by the first luminance distribution calculator, and the second control circuit comprises a second luminance distribution calculator configured to derive a luminance distribution of light from the light source based on the lighting quantity information, and a second gradation corrector configured to correct gradation values indicated by pixel signals included in the second signals based on the luminance distribution derived by the second luminance distribution calculator.

3. The display device according to claim 1, wherein the light emission intensity of each of the light-emitting areas is determined based on a highest gradation value of the pixels arranged in positions corresponding to the respective light-emitting areas.

4. The display device according to claim 3, wherein each of a plurality of partial areas of the display area corresponding to the light-emitting areas comprises a plurality of pixels.

5. The display device according to claim 1, further comprising a third control circuit configured to receive third signals corresponding to a portion of the display area different from the portions of the display area corresponding to the first partial image and the second partial image, wherein the first control circuit is configured to transmit the lighting quantity information indicating the light emission intensity of each of the light-emitting areas to the third control circuit, and the first control circuit is disposed between the second control circuit and the third control circuit.

6. A display device comprising:

a display panel that has a display area in which a plurality of pixels are arranged; a light source configured to illuminate the display area;

a first control circuit configured to receive first signals corresponding to a first partial image to be displayed in a portion of the display area; and a second control circuit configured to receive second signals corresponding to a second partial image to be displayed in another portion of the display area, wherein the light source has a plurality of light-emitting areas in each of which a light emission intensity is individually controllable, the first control circuit is configured to transmit lighting quantity information indicating the light emission intensity of each of the light-emitting areas to the second control circuit, the first control circuit comprises a first resolution converter configured to generate first low-resolution data based on the first signals, the first low-resolution data having a resolution lower than that of the first partial image, the second control circuit comprises a second resolution converter configured to generate second low-resolution data based on the second signals, the second low-resolution data having a resolution lower than that of the second partial image, the second control circuit is configured to transmit the second low-resolution data to the first control circuit, the first control circuit comprises a lighting quantity calculator configured to generate the lighting quantity information based on the first low-resolution data and the second low-resolution data, a first luminance distribution calculator configured to derive a luminance distribution of light from the light source based on the lighting quantity information, and a first gradation corrector configured to correct gradation values indicated by pixel signals included in the first signals based on the luminance distribution derived by the first luminance distribution calculator, and the second control circuit comprises a second luminance distribution calculator configured to derive a luminance distribution of light from the light source based on the lighting quantity information, and a second gradation corrector configured to correct gradation values indicated by pixel signals included in the second signals based on the luminance distribution derived by the second luminance distribution calculator.

7. A display device comprising:

a display panel that has a display area in which a plurality of pixels are arranged;

a light source configured to illuminate the display area;

a first control circuit configured to receive first signals corresponding to a first partial image to be displayed in a portion of the display area; and a second control circuit configured to receive second signals corresponding to a second partial image to be displayed in another portion of the display area, wherein the light source has a plurality of light-emitting areas in each of which a light emission intensity is individually controllable, and the first control circuit comprises a first resolution converter configured to generate first low-resolution data based on the first signals, the first low-resolution data having a resolution lower than that of the first partial image, the first control circuit is configured to transmit the first low-resolution data to the second control circuit, the second control circuit comprises a second resolution converter configured to generate second low-resolution data based on the second signals, the low-resolution data having a resolution lower than that of the second partial image, the second control circuit is configured to transmit the second low-resolution data to the first control circuit, the first control circuit comprises a first lighting quantity calculator configured to generate lighting quantity information based on the first low-resolution data and the second low-resolution data, the lighting quantity information indicating the light emission intensity of each of the light-emitting areas, a first luminance distribution calculator configured to derive a luminance distribution of light from the light source based on the lighting quantity information generated by the first lighting quantity calculator, and a first gradation corrector configured to correct gradation values indicated by pixel signals included in the first signals based on the luminance distribution derived by the first luminance distribution calculator, and the second control circuit comprises a second lighting quantity calculator configured to generate the lighting quantity information based on the first low-resolution data and the second low-resolution data, the lighting quantity information indicating the light emission intensity of each of the light-emitting areas, a second luminance distribution calculator configured to derive a luminance distribution of light from the light source based on the lighting quantity information generated by the second lighting quantity calculator, and a second gradation corrector configured to correct gradation values indicated by pixel signals included in the second signals based on the luminance distribution derived by the second luminance distribution calculator.

8. The display device according to claim 7, wherein the light emission intensity of each of the light-emitting areas is determined based on a highest gradation value of the pixels arranged in positions corresponding to the respective light-emitting areas.

9. The display device according to claim 8, wherein each of a plurality of partial areas of the display area corresponding to the light-emitting areas comprises a plurality of pixels.

10. The display device according to claim 7, further comprising a third control circuit configured to receive third signals corresponding to a portion of the display area different from the portions of the display area corresponding to the first partial image and the second partial image, wherein the first control circuit is configured to transmit the lighting quantity information indicating the light emission intensity of each of the light-emitting areas to the third control circuit, and the first control circuit is disposed between the second control circuit and the third control circuit.

11. A display device comprising:

a display panel that has a display area in which a plurality of pixels are arranged;

a light source configured to illuminate the display area;

a first control circuit configured to receive first signals corresponding to a first partial image to be displayed in a portion of the display area; and a second control circuit configured to receive second signals corresponding to a second partial image to be displayed in another portion of the display area, wherein the light source has a plurality of light-emitting areas in each of which a light emission intensity is individually controllable, the first control circuit comprises a first output terminal configured to output lighting quantity information to control the light emission intensity of each of the light-emitting areas individually, the lighting quantity information being based on:

first low-resolution data based on the first signals, the first low-resolution data having a resolution lower than that of the first partial image; and second low-resolution data based on the second signals, the second low-resolution data having a resolution lower than that of the second partial image, the second control circuit comprises a first input terminal configured to receive the lighting quantity information, and the first output terminal is electrically coupled to the first input terminal.

12. The display device according to claim 11, wherein the light emission intensity of each of the light-emitting areas is determined based on a highest gradation value of the pixels arranged in positions corresponding to the respective light-emitting areas.

13. The display device according to claim 12, wherein each of a plurality of partial areas of the display area corresponding to the light-emitting areas comprises a plurality of pixels.

14. The display device according to claim 11, further comprising a third control circuit configured to receive third signals corresponding to a portion of the display area different from the portions of the display area corresponding to the first partial image and the second partial image, wherein the first control circuit is configured to transmit the lighting quantity information indicating the light emission intensity of each of the light-emitting areas to the third control circuit, and the first control circuit is disposed between the second control circuit and the third control circuit.

15. A display device comprising:

a display panel that has a display area in which a plurality of pixels are arranged; a light source configured to illuminate the display area;

a first control circuit configured to receive first signals corresponding to a first partial image to be displayed in a portion of the display area; and a second control circuit configured to receive second signals corresponding to a second partial image to be displayed in another portion of the display area, wherein the light source has a plurality of light-emitting areas in each of which a light emission intensity is individually controllable, the first control circuit comprises a first output terminal configured to output lighting quantity information indicating the light emission intensity of each of the light-emitting areas, the second control circuit comprises a first input terminal configured to receive the lighting quantity information, the first output terminal is electrically coupled to the first input terminal, the second control circuit comprises a second output terminal configured to output, to the first control circuit, second low-resolution data having a resolution lower than that of the second partial image and generated based on the second signals, the first control circuit comprises a second input terminal configured to receive the second low-resolution data, and the second output terminal is electrically coupled to the second input terminal.

16. A display device comprising:

a display panel that has a display area in which a plurality of pixels are arranged;

a light source configured to illuminate the display area;

a first control circuit configured to receive first signals corresponding to a first partial image to be displayed in a portion of the display area; and a second control circuit configured to receive second signals corresponding to a second partial image to be displayed in another portion of the display area, wherein the light source has a plurality of light-emitting areas in each of which a light emission intensity is individually controllable, the first control circuit comprises a first output terminal and a first input terminal, the second control circuit comprises a second output terminal and a second input terminal, the first output terminal is a terminal configured to output first low-resolution data having a resolution lower than that of the first partial image and generated based on the first signals, the second output terminal is a terminal configured to output second low-resolution data having a resolution lower than that of the second partial image and generated based on the second signals, the first input terminal is a terminal configured to receive the second low-resolution data, the second input terminal is a terminal configured to receive the first low-resolution data, the first output terminal is electrically coupled to the second input terminal, and the second output terminal is electrically coupled to the first input terminal.

17. The display device according to claim 16, wherein the light emission intensity of each of the light-emitting areas is determined based on a highest gradation value of the pixels arranged in positions corresponding to the respective light-emitting areas.

18. The display device according to claim 17, wherein each of a plurality of partial areas of the display area corresponding to the light-emitting areas comprises a plurality of pixels.

19. The display device according to claim 16, further comprising a third control circuit configured to receive third signals corresponding to a portion of the display area different from the portions of the display area corresponding to the first partial image and the second partial image, wherein the first control circuit is configured to transmit the lighting quantity information indicating the light emission intensity of each of the light-emitting areas to the third control circuit, and the first control circuit is disposed between the second control circuit and the third control circuit.

* * * * *